United States Patent [19]

Fujita et al.

[11] Patent Number: 4,857,442

[45] Date of Patent: Aug. 15, 1989

[54] METHOD FOR THE PROCESSING OF SILVER HALIDE COLOR PHOTOGRAPHIC MATERIALS

[75] Inventors: Yoshihiro Fujita; Toshihiro Nishikawa, both of Kanagawa, Japan

[73] Assignee: Fuji Photo Film Co., Ltd., Kanagawa, Japan

[21] Appl. No.: 920,137

[22] Filed: Oct. 17, 1986

[30] Foreign Application Priority Data

Oct. 19, 1985 [JP] Japan ..... 60-234090

[51] Int. Cl.[4] ..... G03C 1/08; G03C 7/00; G03C 7/40; G03C 7/32

[52] U.S. Cl. ..... 430/393; 430/372; 430/381; 430/384; 430/385; 430/552; 430/553

[58] Field of Search ..... 430/393, 381, 384, 385, 430/372, 552, 553

[56] References Cited

U.S. PATENT DOCUMENTS

| | | | |
|---|---|---|---|
| 4,228,070 | 10/1980 | Milner et al. . | |
| 4,254,212 | 3/1981 | Yagihara et al. . | |
| 4,296,199 | 10/1981 | Yagihara et al. . | |
| 4,433,050 | 2/1984 | Abe et al. . | |
| 4,444,870 | 4/1984 | Hirano et al. | 430/381 |
| 4,455,366 | 6/1984 | Hirano et al. | 430/381 |
| 4,495,272 | 1/1985 | Yagihara et al. | 430/381 |
| 4,511,647 | 4/1985 | Hirano et al. | 430/381 X |
| 4,518,687 | 5/1985 | Hirano et al. | 430/381 X |
| 4,560,645 | 12/1985 | Toriuchi et al. . | |
| 4,584,263 | 4/1986 | Takahashi | 430/372 X |
| 4,601,975 | 7/1986 | Kobooshi et al. | 430/400 X |
| 4,678,743 | 7/1987 | Yamada et al. | 430/553 |
| 4,690,889 | 9/1987 | Saito et al. | 430/552 |
| 4,725,530 | 2/1988 | Kobayashi et al. | 430/552 |

FOREIGN PATENT DOCUMENTS

| | | |
|---|---|---|
| 0071402 | 2/1983 | European Pat. Off. . |
| 106211 | 4/1984 | European Pat. Off. . |
| 8300939 | 3/1983 | PCT Int'l Appl. . |

*Primary Examiner*—Mukund J. Shah

*Attorney, Agent, or Firm*—Birch, Stewart, Kolasch & Birch

[57] ABSTRACT

The present invention provides an economical method for the processing of silver halide color photographic materials comprising fixing or bleach-fixing of the material followed by the washing thereof with a small amount of a washing replenisher. The present method is characterized in that the silver halide color photographic material to be processed contains at least one cyan dye-forming coupler of the following formula (I) or (II) and that the amount of the washing replenisher in the washing step falls within the range of 30 to 50 times of the amount of the processing solution carried over from a previous bath based on the unit area of the photographic material being processed, (I)

(II)

wherein, $R_1$ represents $—CONR_5R_6$, $—NHCOR_5$, $—NHCOOR_7$, $—NHSO_2R_7$, $—NHCONR_5R_6$ or $—NHSO_2NR_5R_6$;

$R_2$ represents a substituent on the naphthol ring;

m is an integer of 0 to 3;

$R_3$ represents a mono-valent organic group;

$R_4$ represents a substituted or unsubstituted aryl group;

X represents a hydrogen atom or a group capable of being released by the coupling reaction with an oxidized aromatic primary amine developing agent;

$R_5$ and $R_6$ each represents a hydrogen atom, an aliphatic group, an aromatic group or a heterocyclic group;

$R_7$ represents an aliphatic group, an aromatic group or a heterocyclic group;

when m is a plural number in the formula, $R_2$'s may be the same or different or may be bonded to each other to form a ring; and $R_2$ and $R_3$, or $R_3$ and X may be bonded to each other to form a ring.

According to the present method, the thermal discoloration of cyan dyes may be prevented and the stability with lapse of time thereof may be improved, and the amount of the washing solution to be used in the washing step may be noticeably reduced.

22 Claims, No Drawings

METHOD FOR THE PROCESSING OF SILVER HALIDE COLOR PHOTOGRAPHIC MATERIALS

FIELD OF THE INVENTION

The present invention relates to a method for the processing of silver halide color photographic materials (hereinafter referred to as "color photographic materials" in short), and more precisely, to an economical and practicable photographic processing method which is effective for inhibiting the thermal discoloration of cyan dyes and which may remarkably reduce the amount of the washing solution to be used in the washing step of the photographic processing.

BACKGROUND OF THE INVENTION

The processing of silver halide photographic materials include a washing step, and the reduction of the amount of water to be used in the washing step has recently been proposed for the prevention of environmental pollution, the economization of water and the reduction of manufacturing costs. For instance, in "Water Flow Rates in Immersion Washing of Motion Picture Film", *Journal of the Society of Motion Picture and Television Engineers,* Vol. 64, pp. 248–253 (May 1955), S. R. Goldwasser proposed a method for reducing the amount of water to be used in the photographic washing step by the use of multi-stage washing tanks of a counter-current system. This method has been applied to various kinds of automatic developing machines, as being effective for the economization of water.

On the other hand, other means have been known, different from the above method, where a stabilization solution containing various kinds of additives is used instead of only water with no additives in the washing step so as to reduce the amount of the processing solution to be used in the step. (Refer to Japanese Patent Application (OPI) Nos. 8542/82, 14834/83, 132146/82, 18631/83 and 184345/84.) (The term "OPI" as used herein means a "published unexamined Japanese patent application".) However, all of the above-mentioned methods have defects in that the thermal discoloration of cyan dyes becomes remarkable when the amount of the processing solution to be used in the washing step is reduced.

Under the circumstances, the object of the present invention is to provide an economical method for processing a silver halide color photographic material which may sufficiently inhibit the thermal discoloration of cyan dyes and which may remarkably reduce the amount of water to be used in the processing.

The present inventors have found that the above-described problems in the prior art may be solved by specifically selecting special cyan couplers which are 1-naphthol-type couplers having a mono-substituted amino group in the 5-position and having higher color image-fastness and color-reproductivity than conventional cyan couplers and/or 1-naphthol-type couplers having an acylamino group in the 2-position and having a higher color image density, incorporating the selected cyan coupler in a color photographic material and processing the material under such condition that the material is washed with water, after being subjected to fixation or bleaching-fixation, while the amount of replenisher of the washing solution is specifically controlled.

SUMMARY OF THE INVENTION

The present invention provides a method for processing a silver halide color photographic material comprising fixing or bleach-fixing of the material followed by the washing thereof, characterized in that the silver halide color photographic material contains at least one cyan dye-forming coupler represented by the following formula (I) or (II) and that the amount of the replenisher of the processing solution in the washing step is to fall within the range of 3 to 50 times the amount of solution carried forward from a previous bath, the amount of replenisher being based on the unit area of the photographic material being processed.

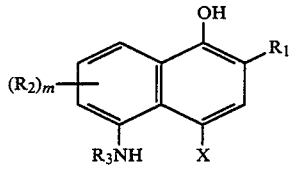

(I)

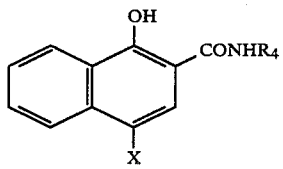

(II)

wherein, $R_1$ represents $—CONR_5R_6$, $—NHCOR_5$, $—NHCOOR_7$, $—NHSO_2R_7$, $—NHCONR_5R_6$ or $—NHSO_2NR_5R_6$, $R_2$ represents a substituent on the napthol ring, m is an integer of 0 to 3, $R_3$ represents a mono-valent organic group, $R_4$ represents a substituted or unsubstituted aryl group, X represents a hydrogen atom or a group capable of being released by the coupling reaction with an oxidized aromatic primary amine developing agent, $R_5$ and $R_6$ may be the same or different and each represents a hydrogen atom, an aliphatic group, an aromatic group or a heterocyclic group, and $R_7$ representes an aliphatic group, an aromatic group or a heterocyclic group, when m is a plural number in the formula, $R_2$'s may be the same or different or may be bonded to each other to form a ring, and $R_2$ and $R_3$, or $R_3$ and X may be bonded to each other to form a ring.

DETAILED DESCRIPTION OF THE INVENTION

The photographic materials to be processed in accordance with the present invention are characterized by containing at least one 1-naphthol-type cyan coupler represented by the aforesaid formula (I) or (II).

The aliphatic group in the formula (I) or (II) herein means an aliphatic hydrocarbon group, including a straight-chain, branched chain or cyclic alkyl group, alkenyl group or alkinyl group, which may be substituted or unsubstituted. The aromatic group means a substituted or unsubstituted ary group, which may be a condensed ring. The heterocyclic ring means a substituted or unsubstituted, mono- or condensed-heterocyclic group.

The substituents in the formulae (I) and (II) will be explained in detail hereunder.

$R_1$ is as mentioned above; and $R_5$, $R_6$ and $R_7$ each may be an aliphatic group having from 1 to 30 carbon atoms, an aromatic group having from 6 to 30 carbon atoms or a heterocyclic group having from 2 to 30 carbon atoms.

$R_2$ is a substituent which may be on the naphthol ring, and typical examples of the substituents are a halogen atom, a hydroxyl group, an aromatic group, an amino group, a carboxyl group, a sulfonic acid group, a cyano group, an aromatic group, a heterocyclic group, a sulfonamido group, a carbonamido group, a carbamoyl group, a sulfamoyl group, an ureido group, an acyl group, an acyloxy group, an aliphatic-oxy group, an aromatic-oxy group, an aliphatic-thio group, an aromatic thio group, an aliphatic-sulfonyl group, an aromatic-sulfonyl group, a sulfamoylamino group, a nitro group, an imido group, etc. The number of carbon atoms to be contained in $R_2$ is from 0 to 30. When m represents 2 in the formula, one example of the cyclic $R_2$ is a dioxymethylene group.

$R_3$ represents a monovalent organic group and is preferably represented by the following formula (III):

$$R_8(Y)_n- \qquad \text{(III)}$$

wherein

Y represents

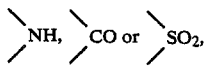

n is 0 or 1, and $R_8$ is a hydrogen atom, an aliphatic group having 1 to 30 carbon atoms, an aromatic group having 6 to 30 carbon atoms, a heterocyclic group having 2 to 30 carbon atoms,

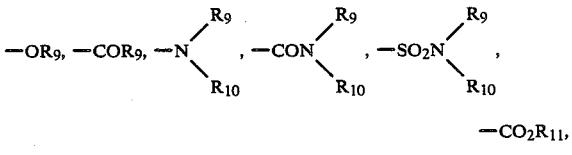

$-CO_2R_{11}$, $-SO_2R_{11}$ or $-SO_2OR_{11}$, wherein $R_9$ and $R_{10}$ have the same meanings as defined for the aforesaid $R_5$ and $R_6$, and $R_{11}$ has the same meanings as defined for the aforesaid $R_7$.

In $R_1$ or $R_8$, the group of

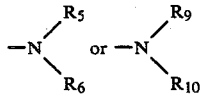

may form a nitrogen-containing heterocyclic ring (such as a morpholine ring; piperidine ring or pyrrolidine ring).

$R_4$ represents a substituted or unsubstituted aryl group, which may be condensed ring. Typical substituents of $R_4$ are a halogen atom, a cyano group, a nitro group, a trifluoromethyl group, $-COOR_{12}$, $-COR_{12}$, $-SO_2OR_{12}$, $-NHCOR_{12}$,

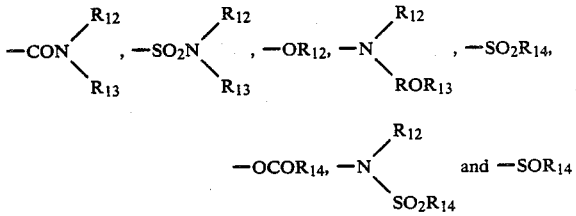

$R_{12}$ and $R_{13}$ may be the same or different and each represents a hydrogen atom, an aliphatic group, an aromatic group or a heterocyclic group.

$R_{14}$ represents an aliphatic group, an aromatic group or a heterocyclic group.

The number of carbon atoms of $R_4$ is from 6 to 30,

X represents a hydrogen atom or a coupling off group.

Typical examples of the coupling off group are a halogen atom,

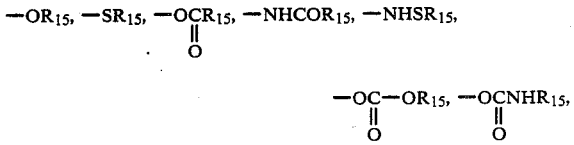

an aromatic-azo group having from 6 to 30 carbon atoms and a heterocyclic group which is bonded to the coupling-active position of the coupler via the nitrogen atom and which has from 1 to 30 carbon atoms (such as succinimido group, phthalimido group, hydantoinyl group, pyrazolyl group or 2-benzotriazolyl group).

$R_{15}$ represents an aliphatic group having from 1 to 30 carbon atoms, an aromatic group having from 6 to 30 carbon atoms or a heterocyclic group having from 2 to 30 carbon atoms.

The aliphatic group as referred to in the present invention may be saturated or unsaturated, substituted or unsubstituted and straight-chain, branched-chain or cyclic, as mentioned in the above, and typical examples thereof are methyl group, ethyl group, butyl group, cyclohexyl group, allyl group, propargyl group, methoxyethyl group, n-decyl group, n-dodecyl group, n-hexadecyl group, trifluoromethyl group, heptafluoropropyl group, dodecyloxypropyl group, 2,4-di-tert-amylphenoxypropyl group, 2,4-di-tert-amylpnenoxybutyl group, etc.

The aromatic group may be substituted or unsubstituted, and typical examples thereof are phenyl group, tolyl group, 2-tetradecyloxyphenyl group, pentafluorophenyl group, 2-chloro-5-dodecyloxycarbonylphenyl group, 4-chlorophenyl group, 4-cyanophenyl group, 4-hydroxyphenyl group, etc.

The heterocyclic group may be substituted or unsubstituted, and typical examples thereof are 2-pyridyl group, 4-pyridyl group, 2-furyl group, 4-thienyl group, quinolinyl group, etc.

Examples of preferred substituents in the compounds of the present invention are mentioned hereinunder.

$R_1$ is preferably $-CONR_5R_6$, and specific examples thereof are carbamoyl group, ethylcarbamoyl group, morpholinocarbonyl group, dodecylcarbamoyl group, hexadecylcarbamoyl group, decyloxypropyl group, dodecyloxypropyl group, 2,4-di-tert-amylphenoxypropyl group, and 2,4-di-tert-amylphenoxybutyl group, etc.

Regarding $R_2$ and m, the case of m=0 where the naphthol ring is unsubstituted is most preferred. When the naphthol ring is substituted by $R_2$, the $R_2$ is preferably a halogen atom, an aliphatic group, a carbonamido group or a sulfonamido group.

Regarding $R_3$, n is the formula (III) is preferably 0, and $R_8$ is preferably —$COR_8$ (such as formyl group, acetyl group, trifluoroacetyl group, chloroacetyl group, benzoyl group, pentafluorobenzoyl group, p-chlorobenzoyl group), —$COOR_9$ (such as methoxycarbonyl group, ethoxycarbonyl group, butoxycarbonyl group, decyloxycarbonyl group, methoxyethoxycarbonyl group, phenoxycarbonyl group), —$SO_2R_{11}$ (such as methanesulfonyl group, ethanesulfonyl group, butanesulfonyl group, hexadecanesulfonyl group, benzenesulfonyl group, toluenesulfonyl group, p-chlorobenzenesulfonyl group), —$CONR_9R_{10}$ (such as N,N-dimethylcarbamoyl group, N,N-diethylcarbamoyl group, N,N-dibutylcarbamoyl group, morpholinocarbonyl group, piperidinocarbonyl group, 4-cyanophenylcarbonyl group, 3,4-dichlorophenylcarbamoyl group, 4-methanesulfonylphenylcarbamoyl group), and —$SO_2NR_9R_{10}$ (such as N,N-dimethylsulfamoyl group, N,N-diethylsulfamoyl group, N,N-dipropylsulfamoyl group). Especially preferred $R_3$ is —$COOR_9$, —$COR_9$ or —$SO_2R_{11}$, and —$COOR_9$ is most preferred among them.

X is preferably a hydrogen atom, a halogen atom, an aliphatic-oxy group having from 1 to 30 carbon atoms (such as methoxy group, 2-methanesulfonamidoethoxy group, 2-methanesulfonylethoxy group, carboxymethoxy group, 3-carboxypropyloxy group, 2-carboxymethylthioethoxy group, 2-methoxyethoxy group, 2-methoxyethylcarbamoylmethoxy group), an aromatic-oxy group having 6 to 30 carbon atoms (such as phenoxy group, 4-chlorophenoxy group, 4-methoxyphenoxy group, 4-tert-octylphenoxy group, 4-carboxyphenoxy group), a heterocyclic-thio group having 2 to 30 carbon atoms (such as 5-phenyl-1,2,3,4-tetrazolyl-1-thio group, 5-ethyl-1,2,3,4-tetrazolyl-thio group) or an aromatic-azo group having from 6 to 30 carbon atoms (such as 4-dimethylaminophenylazo group, 4-acetamidophenylazo group, 1-naphthylazo group, 2-ethoxycarbonylphenylazo group, 2-methoxycarbonyl-4,5-dimethoxyphenylazo group).

$R_4$ is preferably a naphthyl group, or a phenyl group having an aromatic oxy group or halogen atom in the 2-position (such as 2-chlorophenyl group, 2-ethoxyphenyl group, 2-propyloxy phenyl group, 2-butyloxyphenyl group, 2-dodecyloxyphenyl group, 2-tetradecyloxyphenyl group, 2-(2-hexyldecyloxy)phenyl group, 2-chloro-5-dodecyloxycarbonylphenyl group).

The coupler of the formulae (I) and (II) may form dimers, oligomers or more polymers. More precisely, the couplers of the formula (I) may be bonded to each other via a divalent or more polyvalent group as derived from the substituent of $R_1$, $R_2$, $R_3$ or X in the formula, and those of the formula (II) may be bonded to each other via a divalent or more polyvalent group derived from the substituent X, each to form the corresponding dimers, oligomers or more polymers. In this case, the range of the number of the carbon atoms as defined for the aforesaid substituents need not be adapted to the cases of the present dimers or other polymers.

Typical examples of the couplers of the formula (I) or (II) forming polymers are mono- or copolymers of cyan dye-forming coupler residue-containing addition-polymerizable ethylenic unsaturated compounds (cyan-color forming monomers). In this case, the polymers contain a repeating unit of the following formula (IV), and the polymers may contain one or more kinds of the cyan-color forming repeating units of the formula (IV). When the polymers are copolymers, the copolymers may contain one or more non-coloring ethylenic monomers as the copolymerizing component.

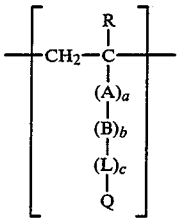

(IV)

wherein

R represents a hydrogen atom, an alkyl group having from 1 to 4 carbon atoms or a chlorine atom, A represents —CONH—, —COO—, or a substituted or unsubstituted phenylene group, B represents a substituted or unsubstituted alkylene group, phenylene group, or aralkylene group, L represents —CONH—, —NHCONH—, —NHCOO—, —NHCO—, —OCONH—, —NH—, —COO—, —OCO—, —CO—, —O—, —$SO_2$—, —$NHSO_2$—, or —$SO_2NH$—, a, b and c each is 0 or 1, and Q represents a cyan coupler residue as derived from the compound represented by the formula (I) or (II) by the release of a hydrogen atom therefrom (except for the hydrogen atom of the 1-positioned hydroxyl group).

The polymers are preferably copolymers comprising cyan color forming monomers for the coupler units of the formula (IV) and non-coloring ethylenic monomers as mentioned below.

Examples of the non-coloring ethylenic monomers which do not couple with an oxidized product of an aromatic primary amine-developing agent are acrylic acid, α-chloroacrylic acid, α-alkylacrylic acids (such as methacrylic acid) and esters or amides derived from these acrylic acids (such as acrylamide, methacrylamide, n-butylacrylamide, t-butylacrylamide, diacetonacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxyethyl methacrylate), vinyl esters (such as vinyl acetate, vinyl propionate and vinyl laurate), acrylonitrile, methacrylonitrile, aromatic vinyl compounds (such as styrene and derivatives thereof, e.g., vinyltoluene, divinylbenzene, vinylacetophenone and sulfostyrene), itaconic acid , citraconic acid, crotonic acid, vinylidene chloride, vinylalkylethers (such as vinylethylether), maleates, N-vinyl-2-pyrrolidone, N-vinylpyridine and 2- and 4-vinylpyridines.

In particular, acrylates, methacrylates and maleates are especially preferred among them. Two or more kinds of these non-coloring ethylenic monomers may be co-used together. For instance, combinations of methyl acrylate and butyl acrylate, butyl acrylate and styrene, butyl methacrylate and methacrylic acid, as well as methyl acrylate and diacetonacrylamide may be used.

As is well known in the field of polymer couplers, the ethylenic unsaturated monomers to be copolymerized with the vinyl monomers corresponding to the aforesaid formula (IV) are to be so selected that these may have a good influence on the physical property and/or the chemical property of the copolymers to be obtained therefrom, including solubility, compatibility with binders (e.g., gelatin) of photographic colloid compositions, softening temperature, flexibility and thermal stability.

The cyan polymer coupler dispersions to be used in the present invention may be obtained by emulsifying and dispersing a solution of the oleophilic polymer coupler which is dissolved in an organic solvent in a gelatin aqueous solution in the form of a latex of the polymer coupler. The polymer coupler is obtained by the polymerization of the vinyl-type monomer for forming the coupler unit of the aforesaid formula (IV). Alternatively, the cyan polymer couplers may directly be obtained by emulsion-polymerization of the monomers.

The method for the emulsification and dispersion of the oleophilic polymer coupler in a gelatin aqueous solution in the form of a latex thereof is described, for example, in U.S. Pat. No. 3,451,820, and the emulsion-polymerization is described, for example, in U.S. Pat. Nos. 4,080,211 and 3,370,952, and these methods may be applied to the present invention.

Specific examples of the couplers of the formula (I) are given hereunder, which are, however, not intended to in any way be limitative. In the following structural formulae, (t)-$C_5H_{11}$ means —$C(CH_3)_2C_2H_5$, and (t)$C_8H_{17}$ means —$C(CH_3)_2CH_2C(CH_3)_3$.

I-1

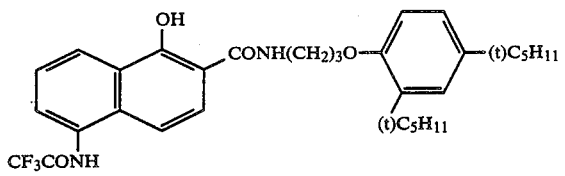

I-2

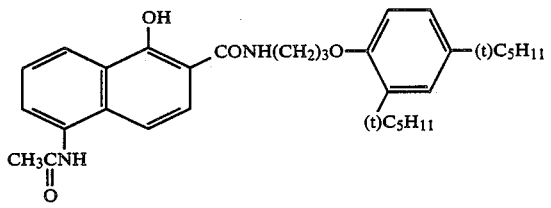

I-3

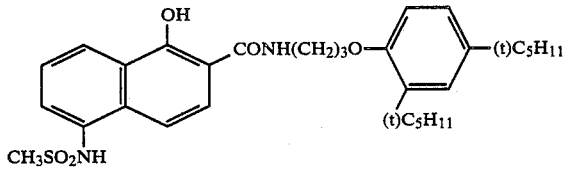

I-4

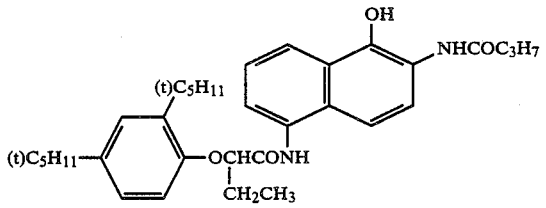

I-5

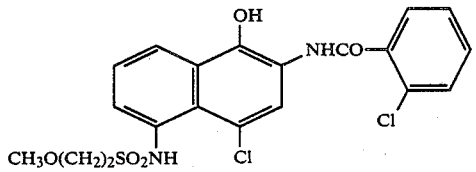

-continued
I-6
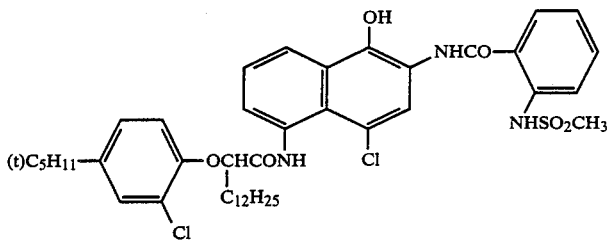
I-7
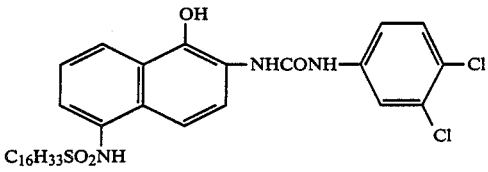
I-8
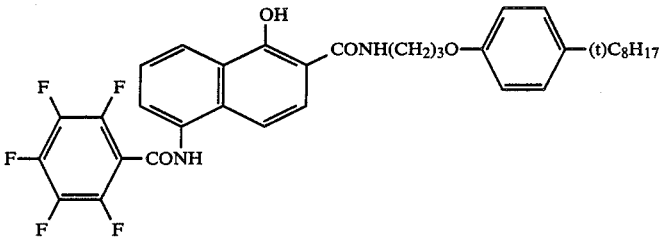
I-9
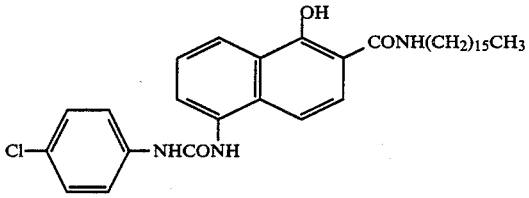
I-10
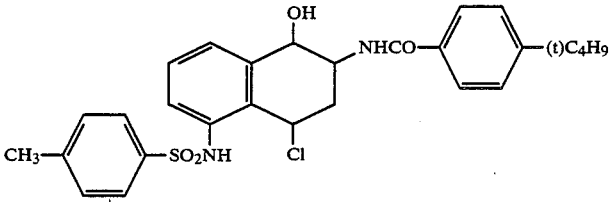
I-11
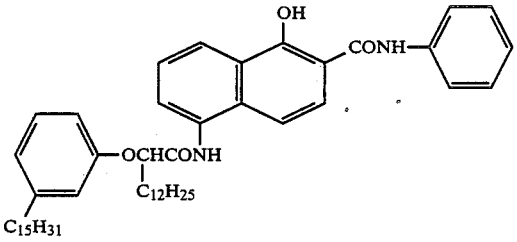
I-12
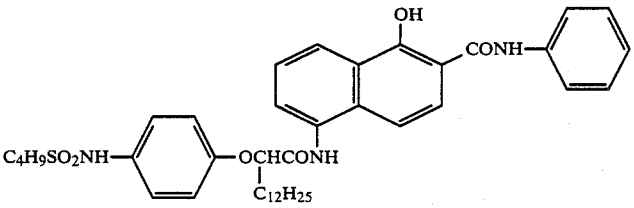

-continued
I-13
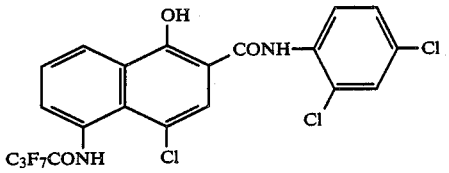
I-14
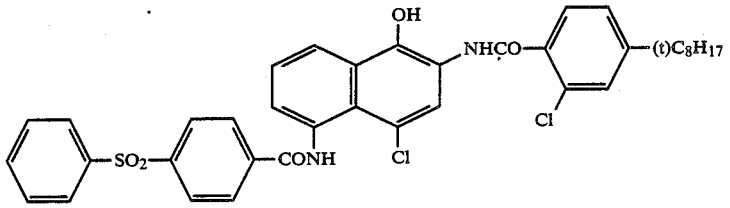
I-15
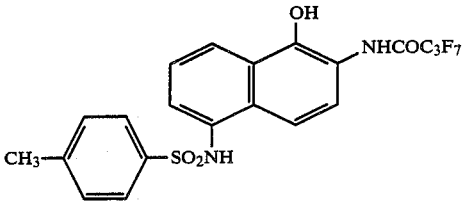
I-16
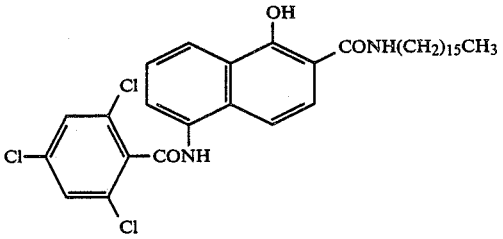
I-17
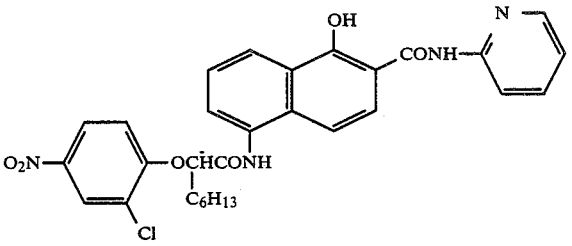
I-18
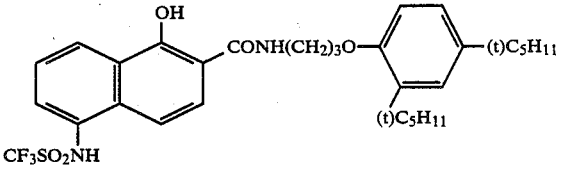
I-19
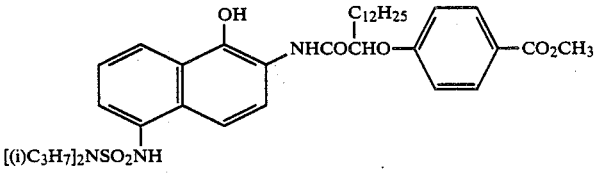

-continued
I-20
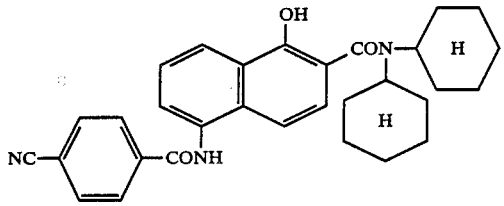
I-21
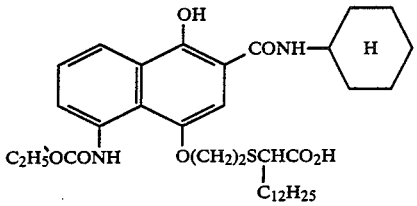
I-22
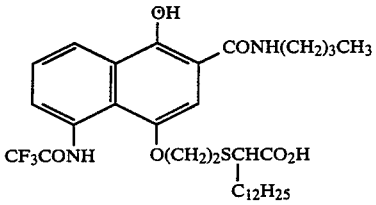
I-23
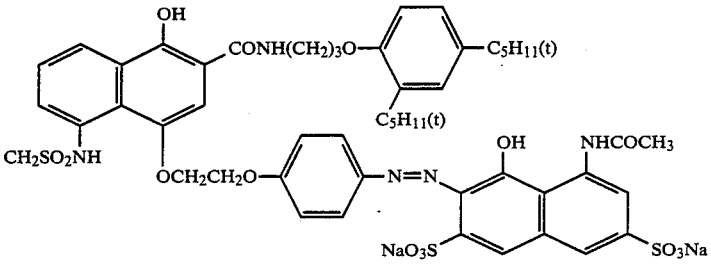
I-24
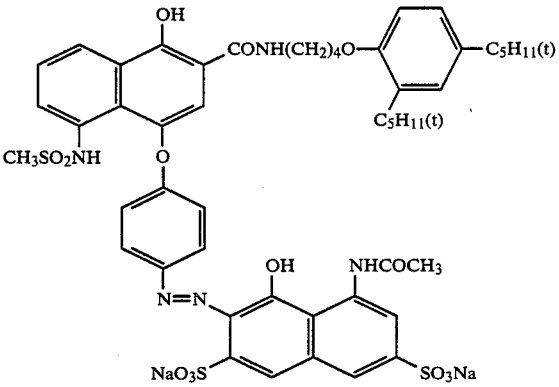
I-25
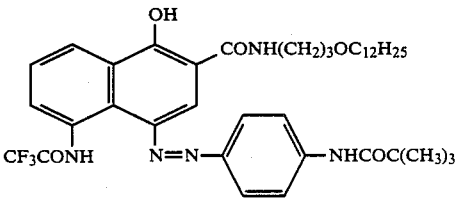

-continued
I-26
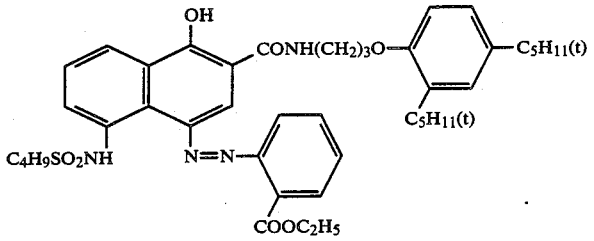
I-27
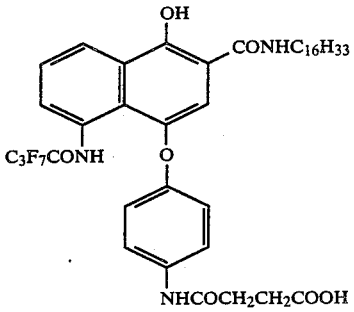
I-28
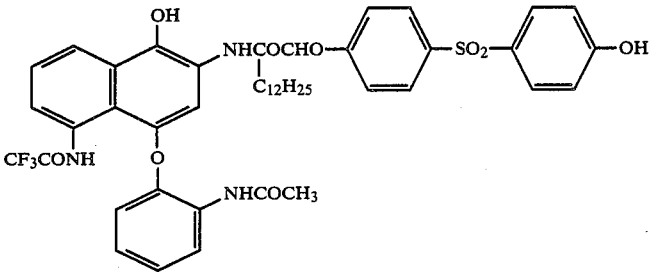
I-29
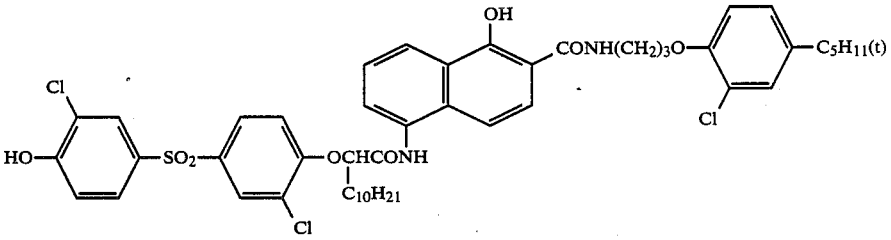
I-30
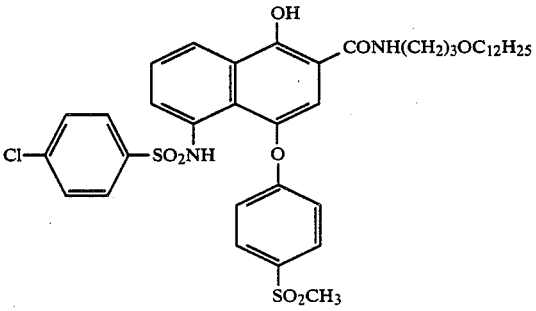

-continued
I-31
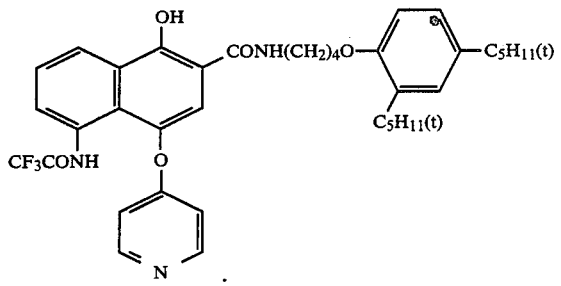
I-32
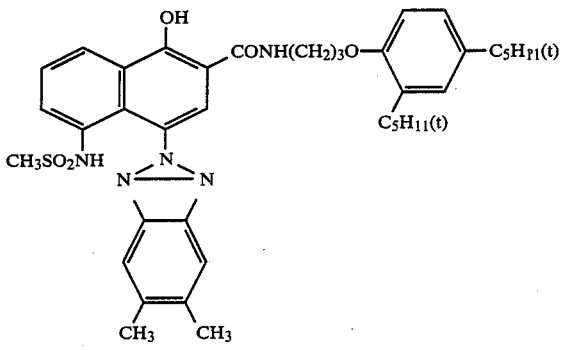
I-33
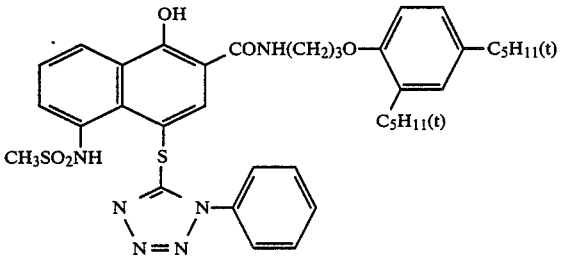
I-34
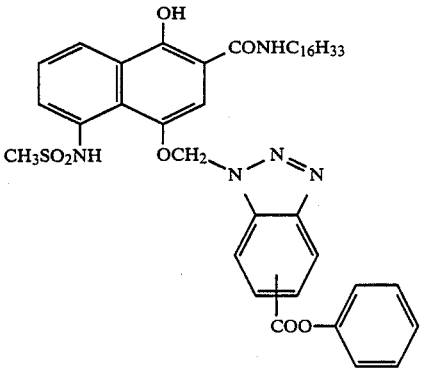

-continued
I-35
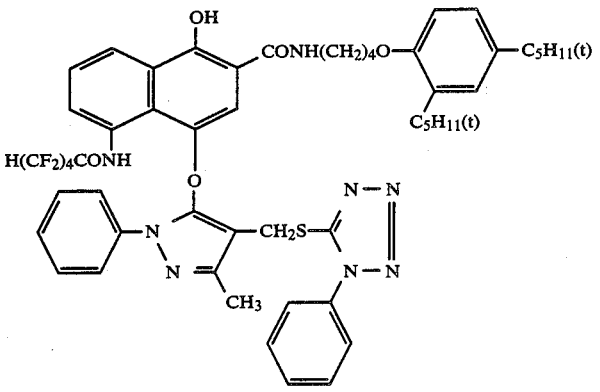
I-36
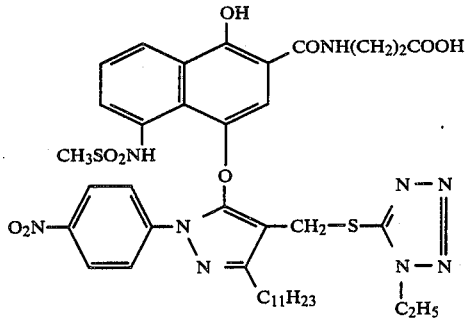
I-37
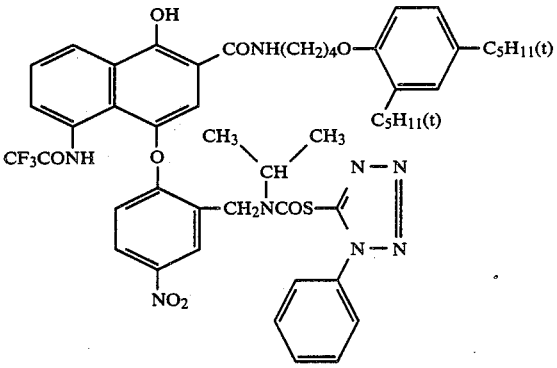
I-38
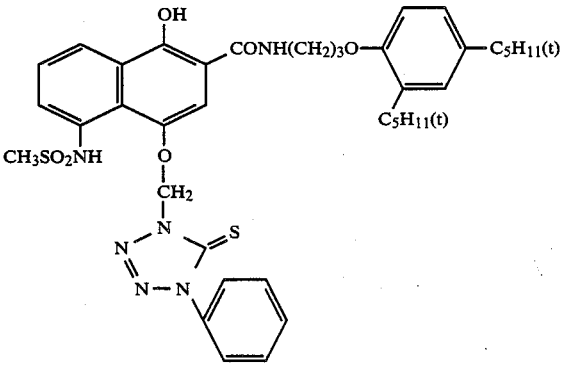

-continued
I-39
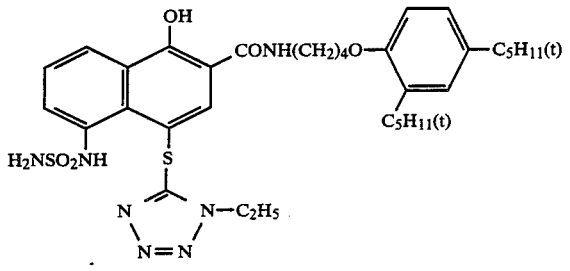
I-40
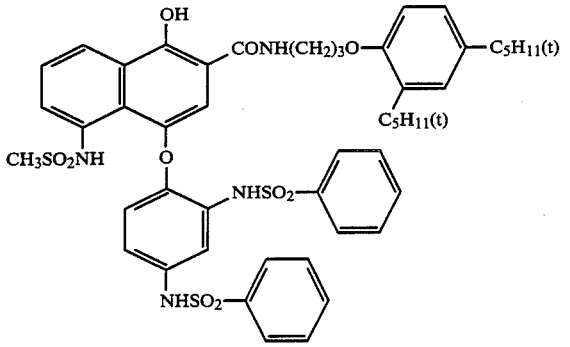
I-41
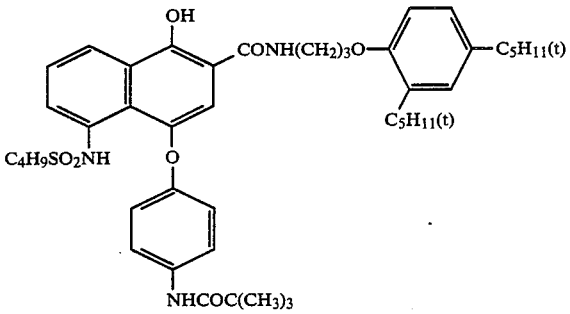
I-42
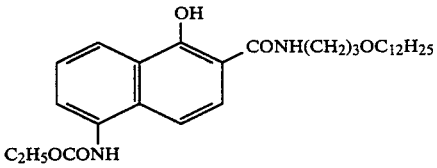
I-43
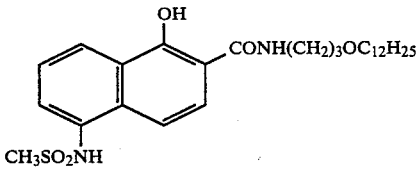
I-44
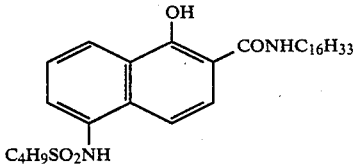

-continued
I-45
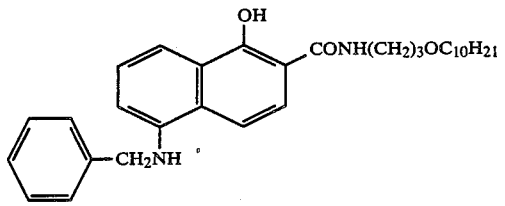
I-46
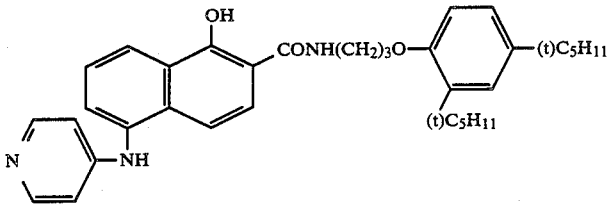
I-47
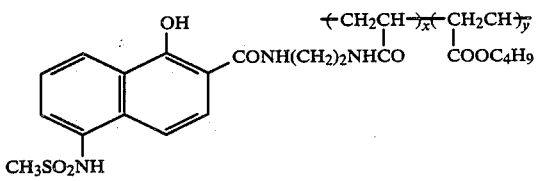
x:y = 70:30 (molar ratio)
I-48
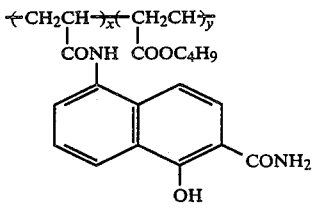
x:y = 50:50 (molar ratio)
I-49
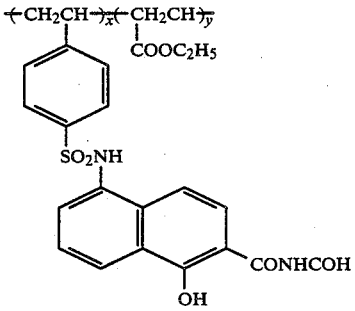
x:y = 60:40 (molar ratio)
I-50
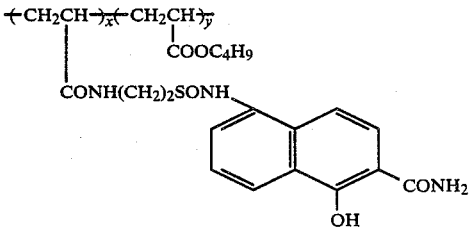
x:y = 80:20 (molar ratio)

-continued
I-51
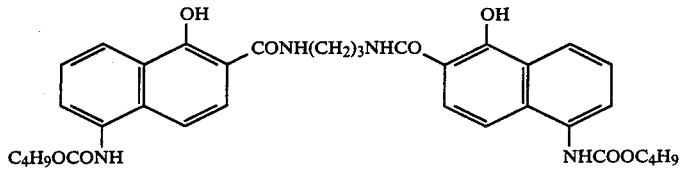
I-52
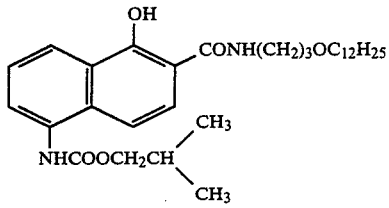
Specific examples of the couplers of the formula (II) are given below.
II-1
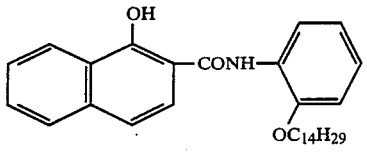
II-2
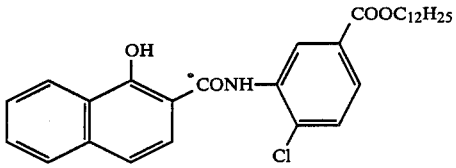
II-3
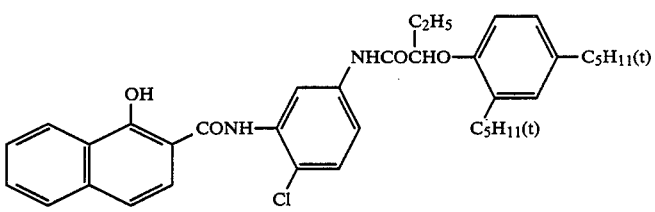
II-4
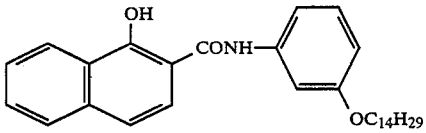
II-5
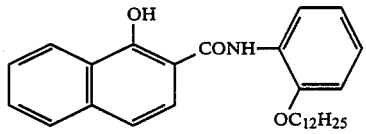
II-6
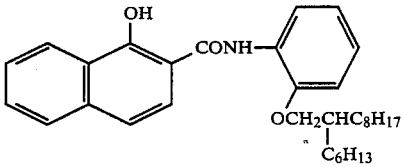

-continued
II-7
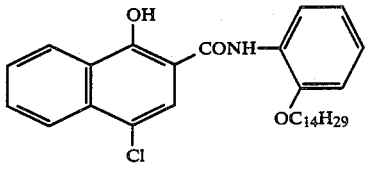
II-8
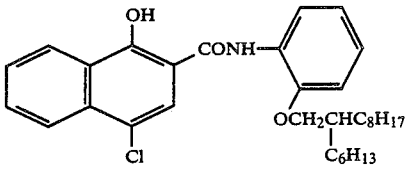
II-9
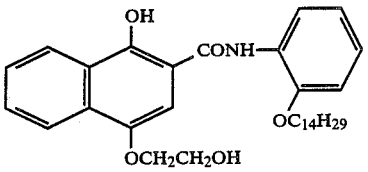
II-10
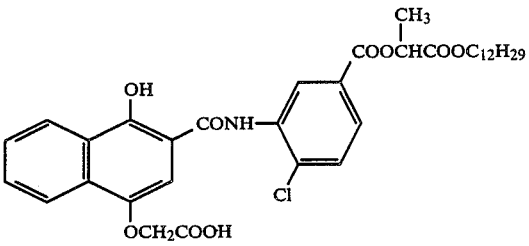
II-11
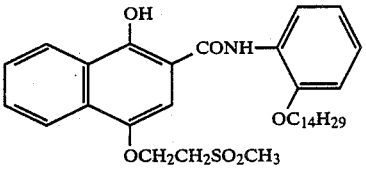
II-12
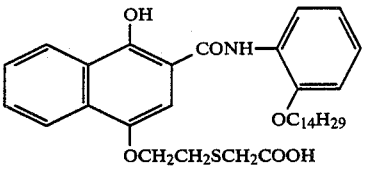
II-13
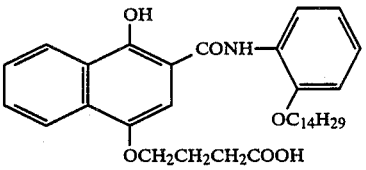
II-14
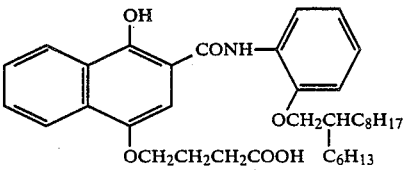

-continued
II-15
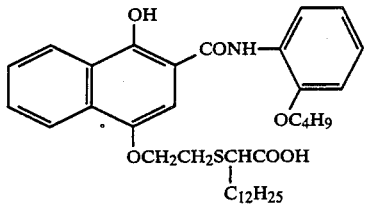
II-16
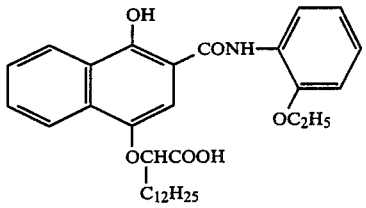
II-17
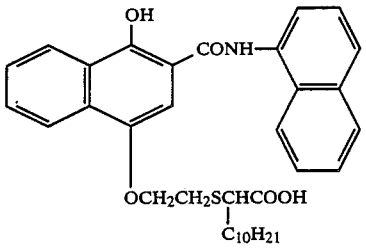
II-18
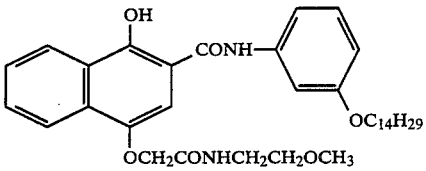
II-19
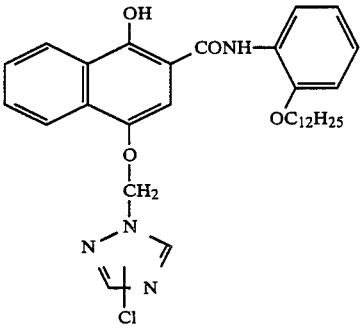
II-20
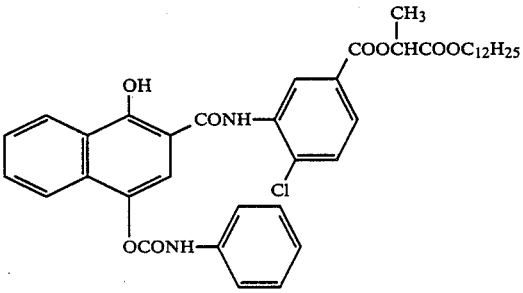

-continued
II-21
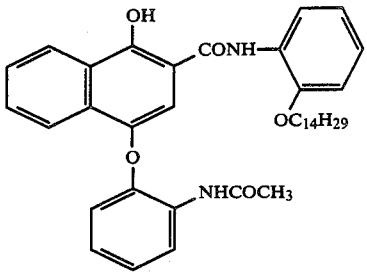
II-22
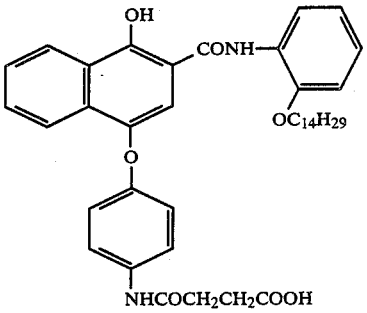
II-23
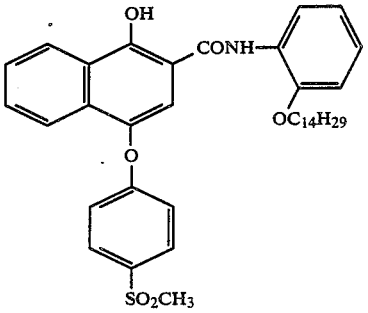
II-24
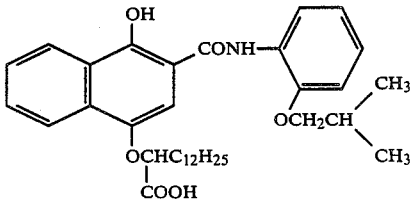
II-25
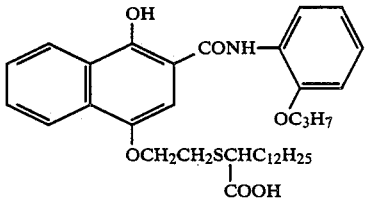
II-26
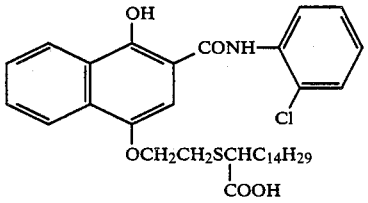

-continued
II-27
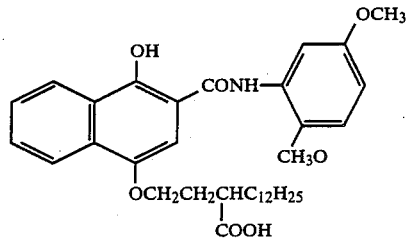
II-28
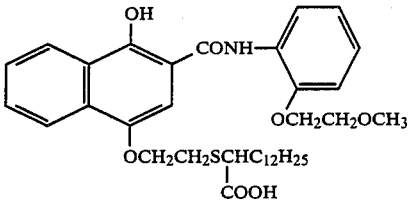
II-29
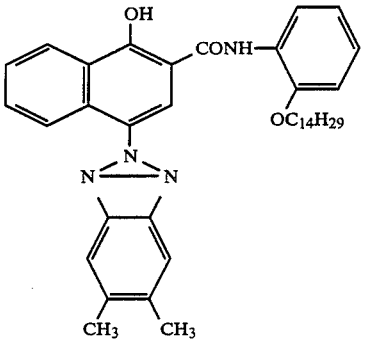
II-30
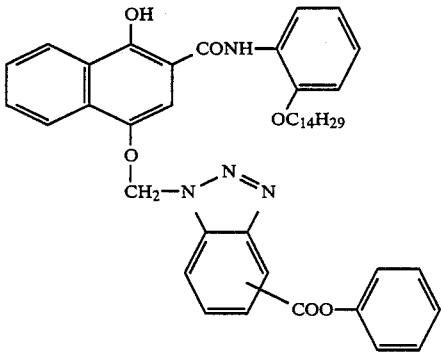
II-31
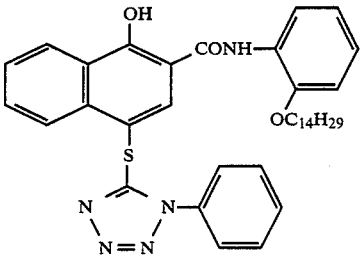

-continued
II-32
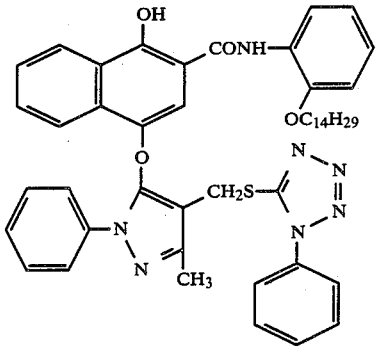
II-33
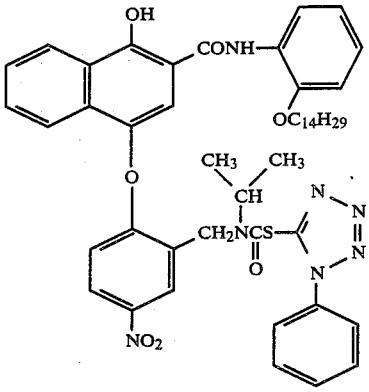
II-34
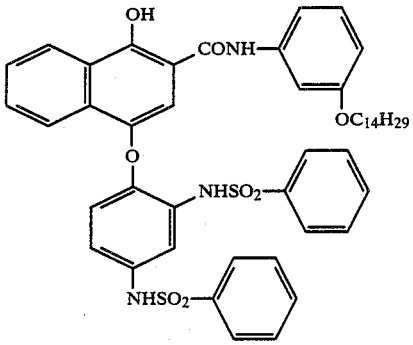
II-35
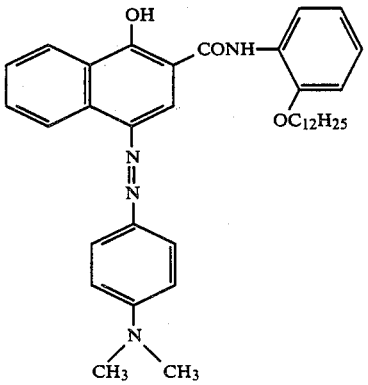

-continued
II-36
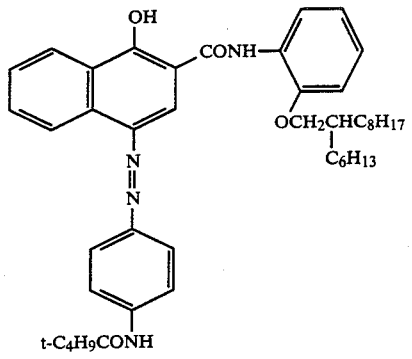
II-37
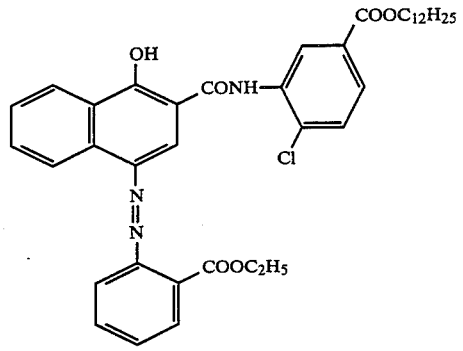
II-38
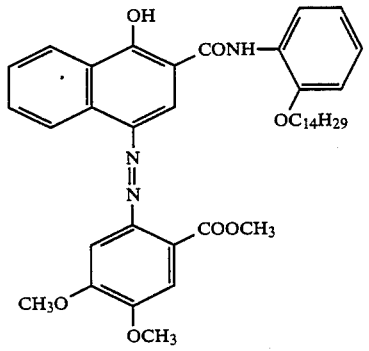
II-39
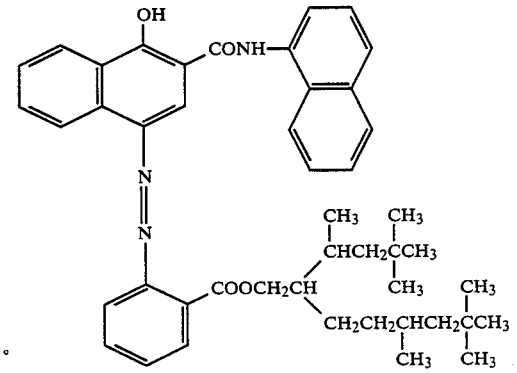

-continued

II-40

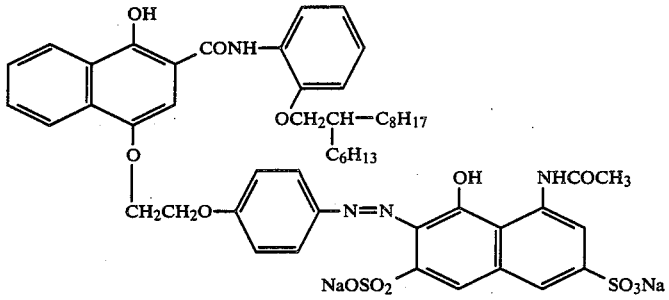

II-41

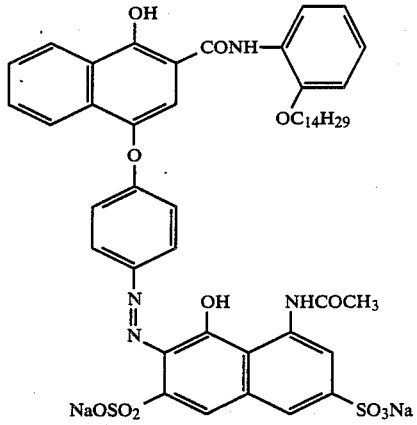

The couplers of the formula (I) may be synthesized in accordance with the method as described in Japanese patent application (OPI) Nos. 237448/86, 145557/86 and 153640/86.

The couplers of the formula (II) may be synthesized in accordance with the method as described in U.S. Pat. No. 3,488,193, Japanese patent application (OPI) Nos. 15529/73, 117422/75, 18315/77, 90932/77, 52423/78, 48237/79, 66129/79, 32071/80, 65957/80, 105226/80, 1938/81, 12643/81, 27147/81, 126832/81 and 95346/83.

In addition to the cyan couplers of the present invention, various kinds of color couplers may be used in the present invention, and typical examples thereof are cyan dye-, magenta dye- and yellow dye-forming couplers as described in the patent specifications which are referred to in *Research Disclosure,* RD No. 17643 (Dec. 1978), VII-D and ibid., RD No. 18717 (Nov. 1979). These are preferably nondiffusive, as being dimerized or more polymerized, and may be either tetra-equivalent couplers or di-equivalent couplers. In addition, couplers capable of forming diffusive dyes for the improvement of graininess as well as DIR-couplers capable of releasing development inhibitors during the coupling reaction for the achievement of the edge effect or interlayer effect may also be used in the present invention.

As the yellow couplers which may be used together with the cyan couplers of the present invention, preferred are oxygen atom- or nitrogen atom-coupling off type-yellow couplers, i.e., α-pivaloyl or α-benzoylacetanilide couplers. Especially preferred examples of these di-equivalent couplers are oxygen atom coupling off type-yellow couplers as described in U.S. Pat. Nos. 3,408,194, 3,447,928, 3,933,501 and 4,022,620, and nitrogen atom coupling off type-yellow couplers as described in U.S. Pat. Nos. 3,973,968, 4,314,023, Japanese patent publication No. 10739/83, Japanese patent application (OPI) No. 132926/75, West German patent application (OLS) Nos. 2,219,917, 2,261,361, 2,329,587 and 2,433,812. As the magenta couplers which may be used together with the cyan couplers of the present invention, 5-pyrazolone-type couplers, pyrazolo[5,1-c][1,2,4]triazoles as described in U.S. Pat. No. 3,725,067 or pyrazolo[5,1-b][1,2,4]triazoles as described in European Pat. No. 119,860 may be used. In addition, di-equivalent magenta couplers are preferred, having a coupling off group bonded to the coupling-active position via a nitrogen atom or a sulfur atom.

The cyan couplers of the present invention and the aforesaid co-usable color image-forming couplers (main couplers) are used, when they are to be incorporated into photographic materials, in the form of a dispersion as emulsified and dispersed in an aqueous medium together with a high boiling point-organic solvent (such as phthalates having from 16 to 32 carbon atoms or phosphates having from 16 to 32 carbon atoms) optionally with another organic solvent (such as ethyl acetate). Regarding the standard amount of the main couplers to be used, the yellow coupler is used at 0.01 to 0.5 mole, the magenta coupler is used at 0.003 to 0.3 mole and the cyan coupler is used at 0.002 to 0.3 mole, each per one mole of the light-sensitive silver haldie.

The couplers of the present invention and other couplers to be combined therewith may be introduced into photographic materials by various known dispersion methods. Typical means for the dispersion are a solid-dispersion method, an alkali-dispersion method, preferably a latex-dispersion method, and more preferably an oil-in-water dispersion method. In the oil-in-water dispersion method, the coupler is dissolved in a single liquid of a high boiling point-organic solvent having a boiling point of 175° C. or higher or a so-called auxiliary solvent of a low boiling point-solvent or in the mixture of these solvents, and then, the resulting solution is finely dispersed in water or in an aqueous medium such as a gelatin-aqueous solution, in the presence of a surfactant. Examples of the high boiling point-organic solvents are described, for example, in U.S. Pat. No. 2,322,027. The dispersion may be accompanied by phase inversion. If necessary, the auxiliary solvent as used may be removed or reduced by distillation, noodle washing or ultrafiltration, and then the resulting solution may be coated for the formation of the photographic materials.

Specific examples of the high boiling-organic solvents usable in the present invention are phthalates (such as dibutyl phthalate, dicyclohexyl phthalate, di-2-ethylhexyl phthalate, decyl phthalate), phosphates and phosphonates (such as triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoates (such as 2-ethylhexyl benzoate, dodecyl benzoate, 2-ethylhexyl-p-hydroxy benzoate), amides (such as diethyldodecanamide, N-tetradecylpyrrolidone), alcohols or phenols (such as isostearyl alcohol, 2,4-di-tert-amylphenol), aliphatic carboxylates (such as dioctyl azelate, glycerol tributyrate, isostearyl lactate, trioctyl citrate), aniline derivatives (such as N,N-dibutyl-2-butoxy-5-tert-octylaniline), hydrocarbons (such as paraffin, dodecylbenzene, diisopropylnaphthalene), etc. The auxiliary solvent may be an organic solvent having a boiling point of about 30° C. or higher, preferably about 50° C. or higher to about 160° C. or lower, and typical examples thereof are ethyl acetate, butyl acetate, ethyl propionate, methylethylketone, cyclohexanone, 2-ethoxyethyl acetate and dimethylformamide.

The step of the latex dispersion method and the effect thereof as well as specific examples of the latexes to be used for immersion are described in U.S. Pat. No. 4,199,363, West German patent application (OLS) Nos. 2,541,274 and 2,541,230.

In the photographic emulsion layers of the photographic materials of the present invention, any silver halide of silver bromide, silver iodobromide, silver iodochlorobromide, silver chlorobromide and silver chloride may be used. Preferred silver halides are silver iodobromide or silver iodochlorobromide containing 30 mol% or less silver iodide. The especially preferred one among them is silver iodobromide containing 2 mol% to 25 mol% of silver iodide.

The shape of the silver halide grains in the photographic emulsions is not specifically limitative and the grains may be so-called regular grains having a regular crystalline form such as a cubic, octahedral or tetradecahedral crystal form or irregular grains having a spherical or the like irregular crystal form, or otherwise may be those having a crystal defect such as a twinning plane or composite crystalline grains with plural crystalline forms.

Regarding the grain size of the silver halide grains, these may be fine grains having a grain size of 0.1 μm or less or large grains having a projected area diameter of up to 10 μm; and these may comprise a monodisperse emulsion having a narrow grain size distribution or may comprise a polydisperse emulsion having a broad grain size distribution.

Two or more silver halide emulsions which were separately prepared may be blended and used.

Further, tabular grains having an aspect ratio of 5 or more may also be used in the present invention. The tabular grains may easily be prepared in accordance with various methods, for example, as described in Cleve, *Photography Theory and Practice,* (1930), page 131; Gutoff, *Photographic Science and Engineering,* Vol. 14, pp. 248–257 (1970); U.S. Pat. Nos. 4,434,226, 4,414,310 and 4,434,048 and British Pat. No. 2,112,157. The use of the tabular grains is advantageous, as being effective for the intensification of the color-sensitization efficiency of the sensitizing dyes, which is described in detail in the aforesaid U.S. Pat. No. 4,434,226.

The crystalline structure may be uniform, or otherwise the grains may comprise different inner and outer halogen compositions or may have layered structures. These emulsion grains are illustrated in British Pat. No. 1,027,146, U.S. Pat, Nos. 3,505,068 and 4,444,877 and Japanese patent application (OPI) No. 143331/85. The grains may have epitaxial over grown structures with different halogen compositions or may have composite structures with compounds other than silver halides such as silver rhodanide or lead oxide.

The photographic emulsions to be used in the present invention may be spectrally sensitized with photographic sensitizing dyes. Further, the present photographic materials may contain a known antifoggant or stabilizer for prevention of fogging during the manufacture, preservation or photographic processing of the photographic materials or stabilization of the characteristic of the materials. Specific exaples of the additives and the use thereof are described, for example, in U.S. Pat. Nos. 3,954,474 and 3,982,947, Japanese patent publication No. 28660/77, *Research Disclosure,* RD No. 17643 (Dec. 1978), VIA to VIM, and E. J. Birr, *Stabilization of Photographic Silver Halide Emulsions,* Focal Press (1974).

The photographic materials of the present invention may contain hydroquinones, aminophenols or sulfonamidophenols as a color fog preventing agent or color stain-preventing agent. Further, the present photographic materials may contain various kinds of fading preventing agents, and typical examples thereof are organic fading preventing agents such as 5-hydroxycoumaranes and spirochromanes and metal complex-type fading preventing agents such as bis(N,N-dialkyldithiocarbamato)/nickel complexes.

The photographic materials of the present invention may contain an ultraviolet-absorbent such as benzotriazoles, and typical examples thereof are described, for example, in *Research Disclosure,* RD No. 24239 (June 1984). The present photographic materials may further contain a filter dye or a water-soluble dye for prevention of irradiation or halation, or for other purposes, in the hydrophilic colloid layer.

The bnder in the photographic light-sensitive layers or the backing layers in the present photographic materials may be a gelatin, a modified gelatin or a synthetic hydrophilic polymer. Further, a hardener such as vinylsulfone derivatives may be incorporated in any desired hydrophilic colloid layer, and a vinyl polymer containing a sulfinic acid salt in the side chain may be used as a hardening accelerators.

The photographic materials of the present invention may contain one or more surfactants for the purpose of coating aid, prevention of antistatic properties, improvement of sliding properties, emulsification and dispersion, prevention of adhesion and improvement of photographic characteristics (e.g., development acceleration, contrast intensification and sensitization), and typical examples thereof are described, for example, in *Research Disclosure,* RD No. 17643 (December 1978) and ibid., RD No. 18716 (November 1976).

The photographic materials of the present invention may further contain, in addition to the aforesaid additives, other various kinds of additives which are known to be useful for photographic light-sensitive materials, such as stabilizers, stain preventing agents, developing agents or precursors thereof, development-accelerators or precursors thereof, lubricants, mordants, matting agents, antistatic agents, plasticizers, etc. Typical examples of these additives are described in *Research Disclosure,* RD No. 17643 (December 1978) and ibid., RD No. 18716 (November 1976).

The present invention is preferably adapted to high-sensitive color films for photographing which have at least two emulsion layers each having a same color-sensitivity and a different sensitivity on a support. The typical order of the arrangement of the layers is a red-sensitive layer, a green-sensitive layer and a blue-sensitive layer from the side of the support. Different from this, a reversed layer arrangement is possible where a high-sensitive layer is sandwiched between emulsion layers having different color-sensitivies.

The method of the present invention is characterized in that the color photographic material containing the cyan coupler(s) of the aforesaid formula (I) and/or (II) is, after being subjected to fixing or bleach-fixing in a conventional manner, processed in a washing bath while a washing replenisher is added thereto in an amount of 3 to 50 times, per the unit area of the photogaphic material, the amount of the fixing solution carried forward from a previous fixing bath. In the method of the present invention, the washing step is to follow the fixing step. A fixing step means a processing step with an aqueous solution for the purpose of removing photographically processed products or components used in the processing baths which have been occluded in the photographic materials or have adhereed to the surface thereof. The step includes any step selected from a so-called washing step, a stabilizing step and a desalting step. Accordingly, the washing solution and the washing bath means an aqueous solution to be used in the said washing step as well as a bath containing the said aqueous solution.

The amount of the liquid to be carried over from the previous processing bath to the washing bath varies, depending upon the conveyer means of the processing machine, the provision of a squeezer therein and the power of the squeezer. The amount of the liquid as carried over from the previous bath may be calculated by directly measuring the weight of the unit area of the photographic material after being processed in the previous bath or by analyzing the concentration of the previous bath components (e.g., iron) in the washing solution after the continuous processing.

As the washing solution, water may be used alone, and in addition, the solution may contain various known compounds for the purpose of preventing precipitation or stabilizing the washing water. For instance, chelating agents such as inorganic phosphoric acids, amino-polycarboxylic acids, and organic phosphonic acids; germicides or fungicides for preventing the generation of various kinds of bacteria, algae or fungi (for example, compounds as described in *J. Antibact. Antifung. Agents,* Vol. 11, No. 5, pp. 207–223 (1983) and compounds as described in H. Horiguchi, *Bokin-Bobaino Kagaku* (Chemistry of Antibacterial and Antifungal Agent); metal salts such as magnesium salts and aluminium salts, as well as alkali metal salts and ammonium salts; and surfactants for the prevention of drying load or unevenness may be added, if necessary. Further, compounds as described in West, *Photo. Sci. Eng.,* Vol. 6, pp. 344–359 (1965) are preferably used. In particular, the addition of the chelating agents as well as germicides and fungicides is effective.

In the method of the present invention, the time required for the washing step varies, depending upon the kinds of the photographic materials to be processed and the conditions in the processing. In general, the time is 20 seconds to 10 minutes, preferably 20 seconds to 5 minutes.

The washing step is preferably carried out by means of a multi-stage counter-current washing means with two or more tanks (for example, 2 to 9 tanks), and the amount of replenisher of the washing solution is to fall within the range of 3 to 50 times, preferably 3 to 20 times, the amount of the processing solution carried over from the previous bath (on the basis of the unit area of the photographic material being processed). In accordance with the present invention, the amount of replenisher may be so small as above and the thermal deterioration of the cyan couplers as contained in the photographic materials to be processed may sufficiently be prevented even by the addition of such a small amount of replenisher because of the characteristic of the specified cyan couplers of the present invention. Thus, the excellent effect of the present invention is apparent. In particular, the photographic materials containing the couplers of the formula (I) are especially preferred, as the effect of the present invention is more noticeable.

The washing solution to be used in the washing step, in accordance with the processing method of the present invention, may contain any desired additives so far as the amount of replenisher of the washing solution satisfies the range as specifically defined in the present invention, and the washing step herein includes the following processes in the field of the present photographic technical field.

(i) Washing process
(ii) Washing and stabilizing process
(iii) Stabilizing process
(iv) Desalting process In these process, each process may be carried out by the counter-current multi tank system. In the case of the process (ii), it is preferred to pay attention thereto so that the stabilizing solution may not be introduced into the washing bath. In each process, the amount of replenisher to each bath is to be within the range of 3 to 50 times the amount of the solution carried over from the previous bath, as described above.

Various kinds of compounds are added to the stabilizing solution to be used in the stabilizing process, for the purpose of stabilization of the images. For instance, various kinds of buffers for the regulation of the film pH (for example, the range of pH 3–8), such as borates, metaborates, borax, phosphates, carbonates, potassium hydroxide, sodium hydroxide, aqueous ammonia, mono-carboxylic acids, di-carboxylic acids and/or poly-carboxylic acids, as well as aldehyde such as formalin are typical. In addition, chelating agents (such as inorganic phosphoric acids, amino-polycarboxylic acids, organic phosphonic acids, aminopolyphoshonic acids, phosphonocarboxylic acids), germicides (such as thiazoles, isothiazoles, halogenated phenols, sulfanylamides, benzotriazoles), surfactants, fluorescent whitening agents, hardeners or the like various kinds of additives may be used, and these additives may be used singly or in the form of a mixture of two or more for the same or different purpose.

The desalting process may be carried out with a processing solution containing fungicides, germicides and chelating agents, etc.

The aqueous solution to be used in the processes of the washing step of the present invention has a pH value of 3.0 to 9.0, preferably 6.0 to 8.0. The solutions are used at 10° to 50° C. preferably 33° to 38° C. Regarding the processing temperature, a higher temperature is possible for the acceleration of the processing step or for the reduction of the processing time, or on the contrary, a lower temperature is possible for improvement of the image quality or for intensification of the stability of the processing solution.

According to the method of the present invention, the aforesaid washing step is essential, and the steps before the fixation step may be any conventional ones, or for example, as mentioned below. In the following steps, washing after the development is optional.

(a) Development-washing-bleaching-fixing
(b) Development-washing-bleaching-washing-fixing
(c) Development-washing-bleach-fixing
(d) Development-washing-bleaching-bleach-fixing The solutions to be used in these steps and the conditions therefor are described below.

The color developer contains a known primary aromatic amino color-developing agent which is widely used in various color photographic process. The developing agents include aminophenols and p-phenylenediamine derivatives. These compounds are more preferably in the form of salts thereof than the free compounds, because of the stability thereof, including hydrochlorides or sulfates. The concentration of the compound in the color developer is about 0.1 g to about 30 g, preferably about 1 g to about 15 g, per one liter of the developer.

Examples of the aminophenol developing agents include o-aminophenol, p-aminophenol, 5-amino-2-hydroxytoluene, 2-amino-3-hydroxytoluene, and 2-hydroxy-3-amino-1,4-dimethylbenzene.

Especially useful primary aromatic amine color developers are N,N-dialkyl-p-phenylenediamine compounds, where the alkyl group and the phenyl group may be substituted or unsubstituted. Particularly preferred compounds among them are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidethyl-3-methyl-4-aminoaniline sulfate, N-ethyl-N-β-hydroxyethylaminoaniline, 4-amino-3-methyl-N,N-diethylaniline, and 4-amino-N-(2-methoxyethyl)-N-ethyl-3-methylaniline-p-toluene-sulfonate.

The alkaline color developers which may be used in the method of the present invention may further contain, in addition to the aforesaid primary aromatic color developing agents, various kinds of additives which are generally added to conventional color developers, for example, alkaline agents (such as sodium hydroxide, sodium carbonate, potassium carbonate), alkali metal sulfites, alkali metal bisulfites, alkali metal thiocyanates, alkali metal halides, benzyl alcohol, water softener and thickener. The color developers generally have a pH value of 7 or more, most generally about 9 to about 13.

The bleaching agents to be used in the bleaching process are, for example, iron (III)-, cobalt (III)-, chromium (IV)-, copper (II)- or the like polyvalent metal compounds (such as ferricyanides), peracids, quinones, nitroso compounds, bichromates, iron (III)- or cobalt (III)- organic complex salts (for example, complex salt of aminopolycarboxylic acids such as ethylenediaminetetraacetic acid, diethylenetriamine-pentaacetic acid, etc., aminopolyphosphonic acids, phosphonocarboxylic acids or organic phosphonic acids), organic acids such as citric acid, tartaric acid or malic acid, persulfates, hydrogen peroxide, and permanganates. In particular, iron (III)-organic complex salts and persulfates are especially preferred in view of the rapid processability and the reduction of environmental pollution. Typical examples of the aminopolycarboxylic acids and aminopolyphosphonic acids and salts thereof to be usable for the formation of the iron (III)-organic complex salts are ethylenediaminetetraacetic acid, diethylenetriaminepentaacetic acid, ethylenediamine-N-(β-hydroxyethyl)-N,N',N'-tetraacetic acid, 1,2-diaminopropanetetraacetic acid, triethylenetetraminehexaacetic acid, propylenediaminetetraacetic acid, nitrilotriacetic acid, nitrilotripropionic acid, cyclohexanediaminetetraacetic acid, 1,3-diamino-2-propanol-tetraacetic acid, methyliminodiacetic acid, iminodiacetic acid, hydroxyliminodiacetic acid, dihydroxyethylglycineethylether-diamine-tetraacetic acid, glycolether-diamine-tetraacetic acid, ethylenediamine-tetrapropionic acid, ethylenediamine-dipropionic acid, phenylenediaminetetraacetic acid, 2-phosphonobutane-1,2,4-triacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, 1-hydroxyethylidene-1,1'-diphosphonic acid, etc.

In particular, iron (III) complex salts of ethylene-diamine-tetraacetic acid, diethylenetriamine-pentaacetic acid, cyclohexanediamine-tetraacetic acid, 1,2-diaminopropane-tetraacetic acid or methylimino-diacetic acid are especially preferred among them, because of the high bleaching power.

The bleaching solutions containing the aforesaid bleaching agents may optionally contain a halogenating agent, for example, bromides (such as potassium bromide, sodium bromide, ammonium bromide), chlorides (such as potassium chloride, sodium chloride, ammonium chloride) or iodides (such as ammonium iodide). In addition, the bleaching solutions may further contain, if necessary, one or more inorganic acids, organic acids and alkali metal or ammonium salts thereof, as a pH-buffer, such as boric acid, borax, sodium metaborate, acetic acid, sodium acetate, sodium carbonate, potassium carbonate, phosphorus acid, phosphoric acid, sodium phosphate, citric acid, sodium citrate or tartaric acid, as well as an antiseptic agent such as ammonium nitrate or guanidine.

The amount of the bleaching agent to be contained in the bleaching solution is suitably 0.1 to 2 moles per one liter of the bleaching solution. The preferred pH range of the solution is preferably 0.5 to 9.0 in case of ferric complex salts, and the pH range is preferably 4.0 to 8.5 in case of ferric complex salts with aminopolycarboxylic acids, aminopolyphosphonic acids, phosphonocarboxylic acids or organic phosphonic acids. In case of persulfates, the concentration is preferably 0.1 to 2 moles/liter, and the pH range is preferably 1 to 5.

The fixing agents to be used in the fixing process may be known ones or water-soluble silver halide solvents, for example, thiosulfates such as sodium thiosulfate and ammonium thiosulfate; thiocyanates such as sodium thiocyanate and ammonium thiocyanate; thioether compounds such as ethylene-bisthioglycolic acid and 3,6-dithia-1,8-octanediol; and thioureas. These may be used singly or in the form of a mixture of two or more of them. The concentration of the fixing agent in the fixing solution is preferably 0.2 to 4 moles/liter. The bleach-fixing solution to be used in the bleach-fixing process contains 0.005 to 0.5 mole, preferably 0.1 to 0.3 mole, of the aforesaid bleaching agent and 0.3 to 3 moles, preferably 0.5 to 2 moles, of the aforesaid fixing agent. The bleach-fixing solution preferably has a pH value of 5–8.

The bleaching solutions, fixing solutions and bleach-fixing solutions may contain, in addition to the aforesaid additives, preservatives selected from sulfites (such as sodium sulfite, potassium sulfite or ammonium sulfite), bisulfites, hydroxylamines, hydrazines, and bisulfite adducts of aldehyde compound (such as an sodium bisulfite adduct of acetaldehyde). In addition, these may further contain various kinds of fluorescent whitening agents, defoaming agents, surfactants or organic solvents such as polyvinylpyrrolidone or methanol.

It is preferred to add a bleaching accelerator selected from compounds having a mercapto group or disulfide bond, thiazolidine derivatives, thiourea derivatives and isothiourea derivatives, to the bleaching solutions or the bleach-fixing solutions.

In order to continuously and stably carry out the processing method of the present invention, it is preferred to begin the process after the composition of the previous bath has been added to each of the successive baths in such degree that the process may run continuously under the consideration of the amount of the previous solution which is to be carried over from the previous bath together with the photographic materials as being processed.

The processing baths may optionally be provided with a heater, a temperature sensor, a liquid-level sensor, a circulating pump, a filter, a floating lid and/or a squeezer, if necessary.

The present invention may be applied to various kinds of color photographic materials. Typical examples are color negative films for general use or movie work, color reversal films for slides or televisions, color papers, color positive films and color reversal papers. In addition, the present invention may be applied to black-and-white photographic materials as attainable by three color coupler-admixture, which are described, for example, in *Research Disclosure,* RD No. 17123 (July 1978). In particular, the present invention is especially preferably applied to color negative films.

The present invention will be explained in greater detail by reference to the following examples, which, however, are not intended to be interpreted as limiting the scope of the present invention.

EXAMPLE 1

The following layers were provided on a triacetylcellulose film support, to obtain a multi-layer color photographic material sample.

First Layer: Anti-halation Layer

Gelatin layer containing black colloidal silver.

Second Layer: Intermediate Layer

Gelatin layer containing emulsified dispersion of 2,5-di-t-octylhydroquinone.

Third Layer: Slow-Speed Red-Sensitive Emulsion Layer

Silver iodobromide emulsion (silver iodide: 5 mol%): 1.6 g-Ag/m$^2$
Sensitizing Dye I: $6\times10^{-5}$ mol per 1 mol of silver
Sensitizing Dye II: $1.5\times10^{-5}$ mol per 1 mol of silver
Coupler EX-1: 0.04 mol per 1 mol of silver
Coupler EX-2: 0.003 mol per 1 mol of silver
Coupler EX-3: 0.0006 mol per 1 mol of silver

Fourth Layer: High-Speed Red-Sensitive Emulsion Layer

Silver iodobromide emulsion (silver iodide: 10 mol%): 1.4 g-Ag/m$^2$
Sensitizing Dye I: $3\times10^{-5}$ mol per 1 mol of silver
Sensitizing Dye II: $1.2\times10^{-5}$ mol per 1 mol of silver
Coupler EX-4: 0.02 mol per 1 mol of silver
Coupler EX-2: 0.0016 mol per 1 mol of silver

Fifth Layer: Intermediate Layer

Same as the second layer.

Sixth Layer: Slow-Speed Green-Sensitive Emulsion Layer

Monodisperse Silver iodobromide emulsion (silver iodide: 4 mol%): 1.2 g-Ag/m$^2$
Sensitizing Dye III: $3\times10^{-5}$ mol per 1 mol of silver
Sensitizing Dye IV: $1\times10^{-5}$ mol per 1 mol of silver
Coupler EX-5: 0.05 mol per 1 mol of silver
Coupler EX-6: 0.008 mol per 1 mol of silver Coupler EX-3: 0.0015 mol per 1 mol of silver

Seventh Layer: High-Speed Green-Sensitive Emulsion Layer

Silver iodobromide emulsion (silver iodide: 10 mol%): 1.3 g-Ag/m$^2$
Sensitizing Dye III: $2.5\times10^{-5}$ mol per 1 mol of silver
Sensitizing Dye IV: $0.8\times10^{-5}$ mol per 1 mol of silver
Coupler EX-7: 0.017 mol per 1 mol of silver
Coupler EX-6: 0.003 mol per 1 mol of silver
Coupler EX-8: 0.003 mol per 1 mol of silver

Eighth Layer: Yellow-Filter Layer

Gelatin layer containing emulsified dispersion of yellow colloidal silver and 2,5-di-t-octylhydroquinone in gelatin-aqueous solution.

Ninth Layer: Slow-Speed Blue-Sensitive Emulsion Layer

Silver iodobromide emulsion (silver iodide: 6 mol%): 0.7 g-Ag/m$^2$
Coupler EX-9: 0.25 mol per 1 mol of silver
Coupler EX-3: 0.015 mol per 1 mol of silver

Tenth Layer: High-Speed Blue-Sensitive Emulsion Layer

Silver iodobromide emulsion (silver iodide: 6 mol%): 0.6 g-Ag/m$^2$
Coupler EX-9: 0.06 mol per 1 mol of silver

Eleventh Layer: First Protective Layer

Silver iodobromide emulsion (silver iodide: 1 mol%, average grain size: 0.07 μm): 0.5 g-Ag/m$^2$ Gelatin layer containing emulsified dispersion of ultraviolet-absorbent UV-1

Twelfth Layer: Second Protective Layer

Gelatin layer containing trimethyl methacrylate particles (diameter: about 1.5 μm) was coated.

Gelatin hardener H-1 and surfactant were added to each layer, in addition to the above components.

The compounds used for the preparation of the above sample were as follows:

Sensitizing Dye I: Anhydro-5,5'-dichloro-3,3'-di-(γ-sulfopropyl)-9-ethyl-thiacarbocyanine-hydroxide pyridinium salt Sensitizing Dye II: Anhydro-9-ethyl-3,3'-di-(γ-sulfopropyl)-4,5,4',5'-dibenzothiacarbocyanine-hydroxide triethylamine salt Sensitizing Dye III: Anhydro-9-ethyl-5,5'-dichloro-3,3'-di-(γ-sulfopropyl)oxacarbocyanine sodium salt Sensitizing Dye IV: Anhydro-5,6,5',6'-tetrachloro-1,1'-diethyl-3,3'-di-{β-[β-(γ-sulfopropyl)ethoxy]ethyl}-imidazolocarbocyanine-hydroxide sodium salt.

EX-1

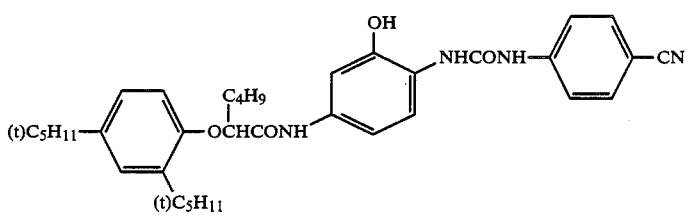

EX-2

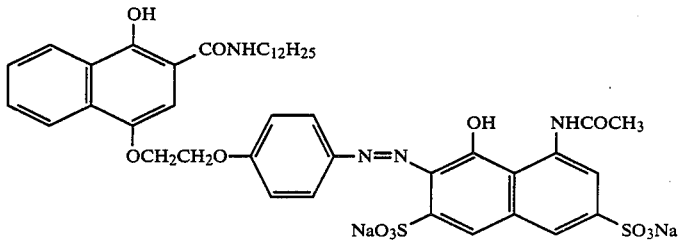

EX-3

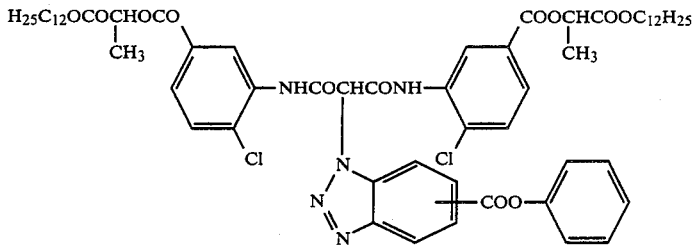

EX-4

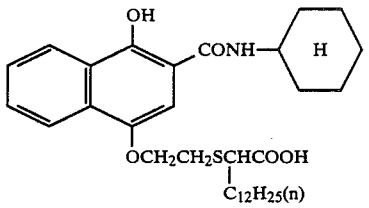

EX-5

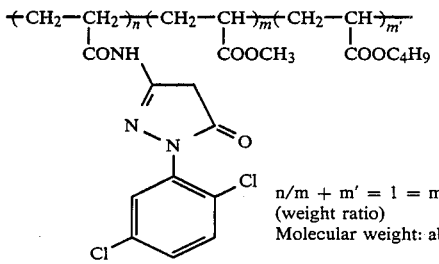

n/m + m' = 1 = m/m' = 1
(weight ratio)
Molecular weight: about 40,000

-continued

EX-6

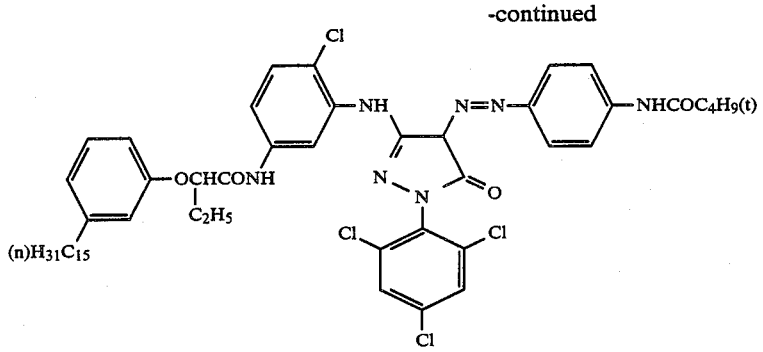

EX-7

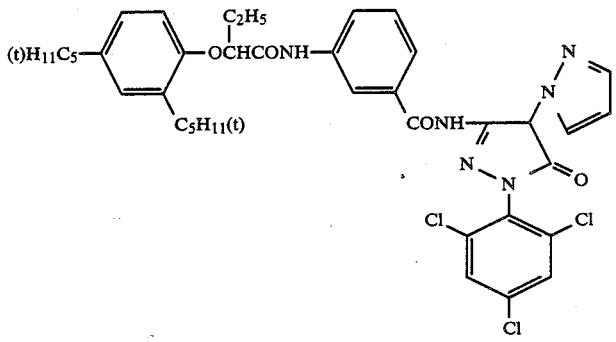

EX-8

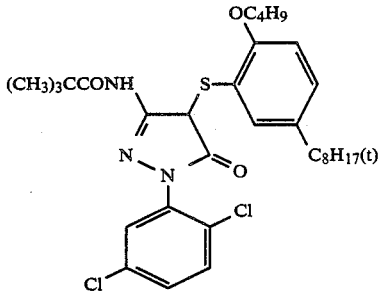

EX-9

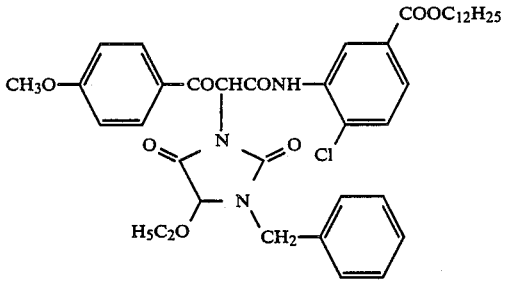

$CH_2{=}CH{-}SO_2{-}CH_2{-}CONH{-}(CH_2)_2NHCOCH_2SO_2CH{=}CH_2$ H-1

UV-1

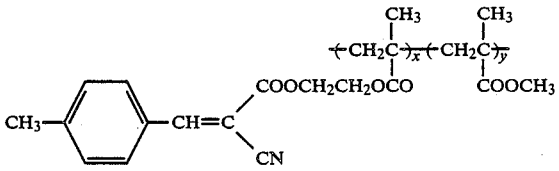

x/y = 7/3 (weight ratio)

The thus prepared color photographic material was cut into a width of 35 mm. A standard object was photographed outdoors with the present sample film, and the thus photographed material was processed with an automatic developing machine under the conditions as shown below. The amount of the replenishers in the washing step (2) and the stabilization step was 27 ml and 33 ml, respectively, which corresponded to about 13 times and about 16 times, respectively, of the amount of the liquid as carried over from the previous bath with the material as being processed.

TABLE 1

| Step | Time | Temperature (°C.) | Capacity of tank (liter) | Amount of replenisher* (ml) |
|---|---|---|---|---|
| Color development | 3'15" | 38 | 18 | 38 |
| Bleach-fixing (1) | 2' | " | 9 | — |
| Bleach fixing (2) | 4' | " | 18 | 50 |
| Washing (1) | 1'30" | " | 9 | — |
| Washing (2) | 1'30" | " | 9 | 27 |
| Stabilizing | 40" | " | 9 | 33 |

Note: *: The amount is based on the length of 1 m of the material having a width of 35 mm.

In the above processing steps, the bleach-fixing steps (1) and (2) and the washing steps (1) and (2) were carried out in a countercurrent system with a counterflow of from (2) to (1).

The composition of each processing solution is given below.

| | Original | Replenisher |
|---|---|---|
| Color developer: | | |
| Diethylenetriamine-tetraacetic acid | 1.0 g | 1.0 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potasssium iodide | 1.3 mg | — |
| Hydroxylamine sulfate | 2.4 g | 2.6 g |
| 4-(N—ethyl-N—β-hydroxyethylamino)-2-methylaniline sulfate | 4.5 g | 5.0 g |
| Water to make | 1 liter | 1 liter |
| pH | 10.00 | 10.05 |
| Bleach-fixing solution: | | |
| Ammonium Fe (III) ethylenediamine-tetraacetate | 80.0 g | 88.0 g |
| Disodium Ethylenediaminetetraacetate | 10.0 g | 11.0 g |
| Bleaching-accelerator of the following formula | 1.0 g | 1.1 g |

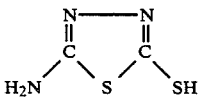

| | | |
|---|---|---|
| Sodium sulfite | 12.0 g | 13.2 g |
| Ammonium thiosulfate-aqueous solution (70%) | 240 ml | 265 ml |
| Water to make | 1 liter | 1 liter |
| Aqueous ammonia (28%) to make pH | 6.8 | 6.6 |

-continued

| | Original | Replenisher |
|---|---|---|
| Washing solution: | | |
| 2-Methyl-isothiazolin-3-one | 10 mg | 10 mg |
| 5-Chloro-2-methylisothiazolin-3-one | 10 mg | 10 mg |
| Water to make | 1 liter | 1 liter |
| Sodium hydroxide to make pH | 7.0 | 7.0 |
| Stabilizing solution: | | |
| Formalin (37% w/v) | 2.0 ml | 3.0 ml |
| Polyoxyethylene-p-monononylphenyl-ether (average polymerization degree: 10) | 0.3 g | 0.45 g |
| Water to make | 1 liter | 1 liter |

The photographed color photographic material (width: 35 mm) was continuously processed with an automatic developing machine having a tank capacity as shown in Table 1 above, in a length of 20 m a day for 20 days. On the other hand, other photographic material samples were prepared in the same manner as above with the exception that the cyan coupler as shown in the following Table 2 was used instead of the cyan couplers EX-1 and EX-4. Each sample was exposed to a tungsten lamp through a wedge of 20 CMS while the color temperature was adjusted to 4800° K. with a filter and then continuously processed for 20 days in the same manner as above.

Each sample thus processed was preserved for 15 days at 80° C., and the variation (discoloration) of the cyan dye before and after the preservation was observed. The results is given in the following Table 2.

TABLE 2

| Sample No. | Cyan dye-forming coupler: Slow-Speed Red-Sensitive Emulsion Layer | Cyan dye-forming coupler: High-Speed Green-Sensitive Emulsion Layer | Variation of Cyan Density (Initial density: 1.2) | Remarks |
|---|---|---|---|---|
| 1 | A | B | 0.20 | Comparative sample |
| 2 | C | B | −0.22 | " |
| 3 | I-(3) | B | −0.10 | Present invention |
| 4 | I-(52) | B | −0.10 | " |
| 5 | II-(1) | B | −0.14 | " |
| 6 | II-(4) | B | −0.15 | " |
| 7 | A | I-(21) −0.09 | " | |
| 8 | A | II-(25) | −0.13 | " |
| 9 | I-(52) | I-(21) | −0.01 | " |
| 10 | I-(52) | II-(25) | −0.04 | " |
| 11 | II-(1) | I-(21) | −0.05 | " |
| 12 | II-(1) | II-(25) | −0.08 | " |

In Table 2, the comparative compounds (A), (B) and (C) are the following cyan dye-forming couplers: Comparative Compound (A)

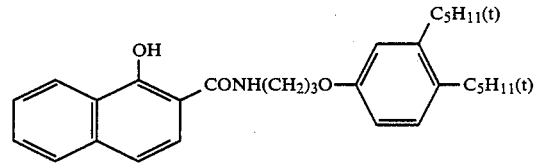

Comparative Compound (B)

-continued

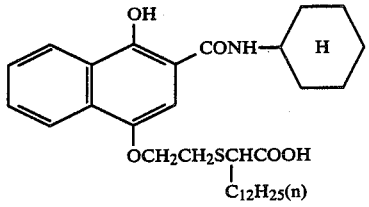

Comparative Compound (C)

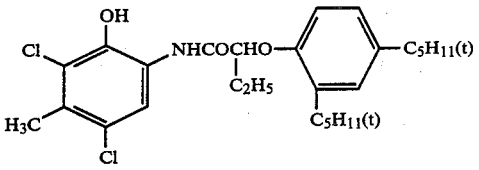

As apparent from Table 2, the stability with lapse of time of the cyan dye was good in each of the samples containing the coupler of the present invention (Sample Nos. 3 to 12). In particular, it is noted that the stability was more improved in Sample Nos. 9 to 12 containing the couplers of the present invention both in the slow-speed emulsion layer and the high-speed emulsion layer. Further, it is especially noted that the couplers of the formula (I) were highly stable and that Sample No. 9 containing the couplers of this type in both of the two layers had the most excellent preservation stability.

Next, the samples were processed in the same manner as above with the exception that ferric diethylenetriaminetetraacetate was used as the bleaching agent in the bleach-fixing solution.

The samples were continuously processed for 20 days in the same manner as above and thereafter subjected to the discoloration test. The same results as in Table 2 were obtained with no difference because of the change of the bleaching agent.

EXAMPLE 2

The color photographic material samples as prepared in Example 1 were photographed in the same manner as Example 1 and then processed with the automatic developing machine under the conditions as shown in Table 3 below. The amount of the replenishers in the wasing step (2) and the stabilization step were 27 ml and 18 ml, respectively, which corresponded to about 13 times and about 9 times, respectively, the amount of the liquid as carried over from the previous bath with the material as being processed.

TABLE 3

| Step | Time | Temperature (°C.) | Capacity of tank (liter) | Amount of replenisher* (ml) |
|---|---|---|---|---|
| Color development | 3'15" | 38 | 10 | 38 |
| Bleaching | 1'00" | " | 4 | 18 |
| Bleach-fixing | 3'15" | " | 10 | 27 |
| Washing (1) | 40" | " | 4 | — |
| Washing (2) | 1'00" | " | 4 | 27 |
| Stabilizing | 40" | " | 4 | 18 |

Note: *: The amount is based on the length of 1 m of the material having a width of 35 mm.

In the above processing steps, the washing steps (1) and (2) were carried out in a countercurrent system with a counterflow of from (2) to (1). The overflow liquid due to the replenishment of the bleaching was introduced into the next bleach-fixing solution.

The composition of each processing solution was as follows:

Color developer:

Both the original and the replenisher were the same as those in Example 1.

| | Original | Replenisher (same as original) |
|---|---|---|
| Bleaching solution: | | |
| Ammonium bromide | 100 g | |
| Ammonium Fe (III) ethylenediaminetetraacetate | 120 g | |
| Disodium ethylenediaminetetraacetate | 10.0 g | |
| Ammonium nitrate | 10.0 g | |
| Bleaching-accelerator of the following formula | 2.0 g | |
| 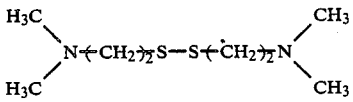 | | |
| Aqueous ammonia | 17.0 ml | |
| Water to make | 1 liter | |
| pH | 6.5 | |
| Bleach-fixing solution: | | |
| Ammonium bromide | 50.0 g | — |
| Ammonium Fe (III) ethylenediaminetetraacetate | 50.0 g | — |
| Disodium ethylenediaminetetraacetate | 5.0 g | 1.0 g |
| Ammonium nitrate | 5.0 g | — |
| Bleaching-accelerator of the following formula | 1.0 g | — |
| 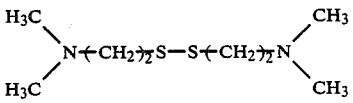 | | |
| Sodium sulfite | 12.0 g | 20.0 g |
| Ammonium thiosulfate aqueous solution (70%) | 240 ml | 400 ml |
| Aqueous ammonia | 10.0 ml | — |
| Water to make | 1 liter | 1 liter |
| pH | 7.3 | 8.0 |
| Washing solution: | | |
| Disodium ethylenediaminetetraacetate | 0.4 g | 0.4 g |
| Water to make | 1 liter | 1 liter |
| Sodium hydroxide to make pH | 7.0 | 7.0 |
| Stabilizing solution: | | |
| Both the original and the replenisher were the same as those in Example 1. | | |

The photographed color photographic material (width: 35 mm) was continuously processed with the automatic developing machine having the tank capacity as shown in the above Table 3, in a length of 20 m a dye for 20 days. After being continuously processed for 20 days, the samples were treated in the same manner as Example 1 and subjected to the same discoloration test.

The results are given in the following Table 4, which were the same as those of Example 1. Next, the samples were processed in the same manner as above with the exception that ferric diethylenetriamine-pentaacetate was used as the bleaching agent in the bleaching solution and in the bleach-fixing solution, and the same results as in Example 1 were obtained.

TABLE 4

| Sample No. | Cyan dye-forming coupler: Slow-Speed Red-Sensitive Emulsion Layer | Cyan dye-forming coupler: High-Speed Red-Sensitive Emulsion Layer | Variation of Cyan Density (Initial density: 1.2) | Remarks |
|---|---|---|---|---|
| 1 | A | B | 0.18 | Comparative sample |
| 2 | C | B | −0.20 | " |
| 3 | I-(3) | B | −0.09 | Present |
| 4 | I-(52) | B | −0.09 | " |
| 5 | II-(1) | B | −0.13 | " |
| 6 | II-(4) | B | −0.14 | " |
| 7 | A | I-(21) | −0.08 | " |
| 8 | A | II-(25) | −0.11 | " |
| 9 | I-(52) | I-(21) | ±0 | " |
| 10 | I-(52) | II-(25) | −0.03 | " |
| 11 | II-(1) | I-(21) | −0.04 | " |
| 12 | II-(1) | II-(25) | −0.06 | " |

EXAMPLE 3

The color photographic materials samples as prepared in Example 1 were photographed in the same manner as Example 1 and processed with the automatic developing machine under the following conditions. The amount of the washing replenisher in the washing step was same as that in Example 1.

TABLE 5

| Step | Time | Temperature (°C.) | Capacity of tank (liter) | Amount of replenisher* (ml) |
|---|---|---|---|---|
| Color development | 3'15" | 38 | 18 | 38 |
| Bleaching | 6'30" | " | 36 | 18 |
| Fixing | 3'15" | " | 18 | 33 |
| Washing (1) | 1'30" | " | 9 | — |
| Washing (2) | 1'30" | " | 9 | 27 |
| Stabilizing | 40" | " | 9 | 33 |

Note: *The amount is based on the length of 1 m of the material having a width of 35 mm.

In the above processing steps, the washing steps (1) and (2) were carried out in a countercurrent system with a counterflow of from (2) to (1).

The composition of each processing solution was as follows:

Color developer:

Both the original and the replenisher were the same as those in Example 1.

Bleaching solution:

| | Original | Replenisher |
|---|---|---|
| Ammonium Fe (III) ethylenediaminetetraacetate | 100 g | 100 g |
| Disodium Ethylenediaminetetraacetate | 10.0 g | 11.0 g |
| Aqueous ammonia | 7 ml | 5 ml |
| Ammonium nitrate | 10.0 g | 12.0 g |
| Ammonium bromide | 150 g | 170 g |
| Water to make | 1 liter | 1 liter |
| pH | 6.0 | 5.8 |

Fixing solution:

| | Original | Replenisher |
|---|---|---|
| Disodium ethylenediaminetetraacetate | 1.0 g | 1.2 g |
| Sodium sulfite | 4.0 g | 5.0 g |
| Sodium bisulfite | 4.6 g | 5.8 g |
| Ammonium thiosulfate aqueous solution (70%) | 175 ml | 200 ml |
| Water to make | 1 liter | 1 liter |
| pH | 6.6 | 6.6 |

Washing solution:

Both the original and the replenisher were the same as those in Example 2.

-continued

Stabilizing solution:

Both the original and the replenisher were the same as those in Example 1.

The samples were continuously processed for 20 days in the same manner as Example 1 and then subjected to the same discoloration test.

The results were the same as those in Table 4. Next, the samples were processed in the same manner as above with the exception that ferric diethylenetriaminepentaacetate was used as the bleaching agent in the bleaching solution, and the same results as in Table 4 were obtained.

As is apparent from the above results, the photographic light-sensitive materials containing the couplers of the present invention may satisfactorily be processed in the economized washing step with a small amount of the washing solution after any desilvering step and may form cyan images of high stability with lapse of time.

While the invention has been described in detail and with reference to specific embodiments thereof, it will be apparent to one skilled in the art that various changes and modifications can be made therein without departing from the spirit and scope thereof.

What is claimed is:

1. A method for the processing of silver halide color photographic materials comprising:

fixing or bleach-fixing a silver halide color photographic material; and washing said photographic material with a replenisher in two or more baths, wherein said silver halide color photographic material contains at least one cyan dye-forming coupler of the following formula (I) or (II) and the amount of the washing replenisher in a particular one of said baths is from 3 to 50 times the amount of the processing solution carried over from a previous bath, based on the unit area of the photographic material being processed:

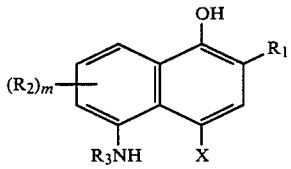

(I)

-continued

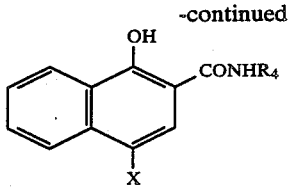

(II)

wherein, $R_1$ represents $—CONR_5R_6$, $—NHCOR_5$, $—NHCOOR_7$, $—NHSO_2R_7$, $—NHCONR_5R_6$ or $—NHSO_2NR_5R_6$;

$R_2$ represents a substituent on the naphthol ring;

m is an integer of 0 to 3;

$R_3$ represents a mono-valent organic group;

$R_4$ represents a subtituted or unsubstituted aryl group;

X represents a hydrogen atom or a group capable of being released by the coupling reaction with an oxidized aromatic primary amine developing agent;

$R_5$ and $R_6$ each represents a hydrogen atom, an aliphatic group, an aromatic group or a heterocyclic group;

$R_7$ represents an aliphatic group, an aromatic group or a heterocyclic group;

when m is a plural number in the formula, $R_2$'s may be the same or different or may be bonded to each other to form a ring; and $R_2$ and $R_3$, or $R_3$ and X may be bonded to each other to form a ring.

2. The method for the processing of silver halide color photographic material as claimed in claim 1, wherein the silver halide color photographic material contains a cyan dye-forming coupler of the formula (II).

3. The method for the processing of silver halide color photographic materials as claimed in claim 1, wherein $R_2$ in the formula (I) represents a substituent selected from the group consisting of a halogen atom, a hydroxyl group, an amino group, a carboxyl group, a sulfonic acid group, a cyano group, an aromatic group, a heterocyclic group, a carbonamido group, a sulfonamido group, a carbamoyl group, a sulfamoyl group, an ureido group, an acyl group, an acyloxy group, an aliphatic-oxy group, an aromatic-oxy group, an aliphatic-thio group, an aromatic-thio group, an aliphatic-sulfonyl group, an aromatic-sulfonyl group, a sulfamoylamino group, a nitro group and an imido group.

4. The method for the processing of silver halide color photographic material as claimed in claim 1, wherein $R_3$ in the formula (I) represents a group of a formula (III):

$$R_8(Y)_n— \quad \text{(III)}$$

wherein

Y represents

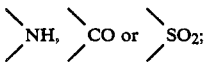

n is 0 or 1;

$R_8$ represents a hydrogen atom, an aliphatic group having from 1 to 30 carbon atoms, an aromatic group having from 6 to 30 carbon atoms, a heterocyclic group having from 2 to 30 carbon atoms, $—OR_9$, $—COR_9$,

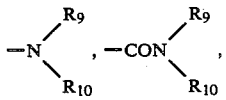

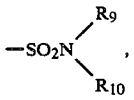

$—CO_2R_{11}$, $—SO_2R_{11}$ or $—SO_2OR_{11}$; and $R_9$, $R_{10}$ and $R_{11}$ have the same meanings as $R_5$, $R_6$ and $R_7$, respectively, in claim 1.

5. The method for the processing of silver halide color photographic materials as claimed in claim 1, wherein

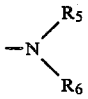

is the formula (I) forms a morpholine ring, piperidine ring or pyrrolidine ring.

6. The method for the processing of silver halide color photographic materials as claimed in claim 4, wherein

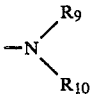

in the formula (III) forms a morpholine ring, piperidine ring or pyrrolidine ring.

7. The method for the processing of silver halide color photographic materials as claimed in claim 1, wherein $R_4$ in the formula (II) represents an unsubstituted aryl group or an aryl group substituted by one or more substituents selected from the group consisting of a halogen atom, a cyano group, a nitro group, a trifluoromethyl group, $—COOR_{12}$, $—COR_{12}$, $—SO_2OR_{12}$, $—NHCOR_{12}$,

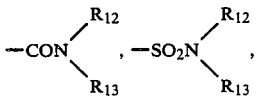

$—OR_{12}$,

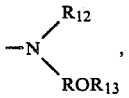

$—SO_2R_{14}$, $—SOR_{14}$, $—OCOR_{14}$ and

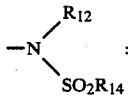

$R_{12}$ and $R_{13}$ each represents a hydrogen atom, an aliphatic group, an aromatic group or a heterocyclic group; and $R_{14}$ represents an aliphatic group, an aromatic group or a heterocyclic group.

8. The method for the processing of silver halide color photographic materials as claimed in claim 1, wherein X in the formulae (I) and (II) represents a hydrogen atom or a coupling off group or an atom selected from the group consisting of a halogen atom, $-OR_{15}$, $-SR_{15}$, $-OCR_{15}$, $-NRCOR_{15}$, $-NHSR_{15}$,

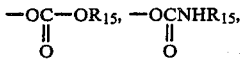

an aromatic-azo group having from 6 to 30 carbon atoms and a heterocyclic group which is bonded to the coupling-active position of the coupler via the nitrogen atom and which has from 1 to 30 carbon atoms and wherein $R_{15}$ represents an aliphatic group having from 1 to 30 carbon atoms, an aromatic group having from 6 to 30 carbon atoms or a heterocyclic group having from 2 to 30 carbon atoms.

9. The method for the processing of silver halide color photographic materials as claimed in claim 8, wherein said heterocyclic group is a succinimido group, a phthalimido group, a hydantoinyl group, a pyrazolyl group or a 2-benzotriazolyl group.

10. The method for the processing of silver halide color photographic material as claimed in claim 1, wherein $R_1$ represents $-CONR_5R_6$; m is 0, or m is an integer of 1 to 3, $R_2$ is a halogen atom, an aliphatic group, a carbonamido group or a sulfonamido group; n is 0; $R_8$ represents $-COR_9$, $-SO_2R_{11}$, $-CONR_9R_{10}$, $-SO_2NR_9R_{11}$; X represents a hydrogen atom, a halogen atom, an aliphatic-oxy group having 1 to 30 carbon atoms, an aromatic-oxy group, a heterocyclic-oxy group or an aromatic-azo group; and $R_4$ represents a 4-cyanophenyl group, a 4-alkylsulfonylphenol group or a halogen-substituted phenyl group.

11. The method for the processing of silver halide color photographic materials as claimed in claim 10, wherein m is 0.

12. The method for the processing of silver halide color photographic materials as claimed in claim 10, wherein $R_3$ represents $-COOR_9$, $-COR_9$ or $-SO_2R_{11}$.

13. The method for the processing of silver halide color photographic materials as claimed in claim 1, wherein the cyan dye-forming couplers of the formulae (I) and (II) are dimers, oligomers or more polymers.

14. The method for the processing of silver halide color photographic materials as claimed in claim 1, wherein the cyan dye-forming couplers of the formulae (I) and (II) are polymers or copolymers having one or more repeating units of the following formula (IV) and optionally having one or more non-coloring ethylenic co-polymerizable monomer:

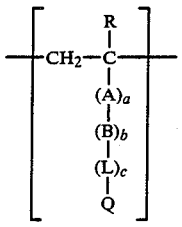

(IV)

wherein

R represents a hydrogen atom, an alkyl group having from 1 to 4 carbon atoms or a chlorine atom;

A represents —CONH—, —COO—, or a substituted or unsubstituted phenylene group;

B represents a substituted or unsubstituted alkylene group, phenylene group, or aralkylene group;

L represents —CONH—, —NHCONH—, —NHCOO—, —NHCO—, —OCONH—, —NH—, —COO—, —OCO—, —CO—, —O—, $-SO_2-$, $-NHSO_2-$, or $-SO_2NH-$;

a, b and c each is 0 or 1, and

Q represents a cyan coupler residue as derived from the compound of the formula (I) or (II) by the release of a hydrogen atom, except for the hydrogen atom of the 1-positioned hydroxyl group.

15. The method for the processing of silver halide color photographic materials as claimed in claim 1, wherein the washing step includes a washing process, a washing and stabilizing process, a stabilizing process and/or desalting process.

16. The method for the processing of silver halide color photographic materials as claimed in claim 1, wherein the washing solution and the washing replenisher in the washing step is water.

17. The method for the processing of silver halide color photographic materials as claimed in claim 1, wherein the washing solution and the washing replenisher in the washing step is an aqueous solution containing a stabilizer and/or additives selected from chelating agents, germicides, fungicides, metal salts, ammonium salts, surfactants, buffer agents, fluorescent-whitening agents and hardeners.

18. The method for the processing of silver halide color photographic materials as claimed in claim 1, wherein the washing step is carried out by means of a multi-stage countercurrent washing means with two or more baths.

19. The method for the processing of silver halide color photographic materials as claimed in claim 1, wherein the amount of the washing replenisher in the washing step is from 3 to 20 times the amount of the solution carried over from the previous bath based on the unit area of the photographic material as being processed.

20. The method for the processing of silver halide color photographic materials as claimed in claim 1, wherein the pH of the washing replenisher is in the range of 3.0 to 9.0.

21. The method for the processing of silver halide color photographic materials as claimed in claim 1, wherein the temperature of the washing replenisher is in the range of 10° to 50° C.

22. A method for the processing of silver halide color photographic materials comprising:

fixing or bleach-fixing a silver halide color photographic material; and washing said photograph material with a replenisher in two or more baths, wherein said silver halide color photographic material contains at least one cyan dye-forming coupler of the following formula (II) and the amount of the washing replenisher in a particular one of said baths is from 3 to 50 times the amount of the processing solution carried over from a previous bath, based on the unit area of the photographic material being processed:

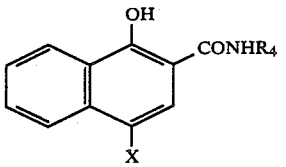

(II)

wherein, $R_1$ represents $—CONR_5R_6$, $—NHCOR_5$, $—NHCOOR_7$, $—NHSO_2R_7$, $—NHCONR_5R_6$ or $—NHSO_2NR_5R_6$;

$R_2$ represents a substituent on the naphthol ring;

m is an integer of 0 to 3;

$R_3$ represents a mono-valent organic group;

$R_4$ represents a substituted or unsubstituted aryl group;

X represents a hydrogen atom or a group capable of being released by the coupling reaction with an oxidized aromatic primary amine developing agent;

$R_5$ and $R_6$ each represents a hydrogen atom, an aliphatic group, an aromatic group or a heterocyclic group;

$R_7$ represents an aliphatic group, an aromatic group or a heterocyclic group;

when m is a plural number in the formula, the $R_2$'s may be the same or different or may be bonded to each other to form a ring; and $R_2$ and $R_3$, or $R_3$ and X may be bonded to each other to form a ring.

* * * * *